US007126594B2

(12) United States Patent
Ishizuka et al.

(10) Patent No.: US 7,126,594 B2
(45) Date of Patent: Oct. 24, 2006

(54) CIRCUIT FOR DRIVING PLASMA DISPLAY PANEL

(75) Inventors: Mitsuhiro Ishizuka, Tokyo (JP); Shinobu Sato, Tokyo (JP); Teruo Okamura, Tokyo (JP)

(73) Assignee: Pioneer Corporation, Tokyo (JP)

( * ) Notice: Subject to any disclaimer, the term of this patent is extended or adjusted under 35 U.S.C. 154(b) by 28 days.

(21) Appl. No.: 10/439,116

(22) Filed: May 16, 2003

(65) Prior Publication Data

US 2003/0218434 A1 Nov. 27, 2003

(30) Foreign Application Priority Data

May 24, 2002 (JP) ..... 2002-150012

(51) Int. Cl.
*G09G 5/00* (2006.01)

(52) U.S. Cl. ..... 345/206; 345/205; 345/212

(58) Field of Classification Search ..... 315/169.4, 315/169.1, 169.3; 345/74–77, 80
See application file for complete search history.

(56) References Cited

U.S. PATENT DOCUMENTS

2002/0154075 A1* 10/2002 Sato et al. ..... 345/60

FOREIGN PATENT DOCUMENTS

| | | | |
|---|---|---|---|
| CN | 1283866 | A | 2/2001 |
| JP | 05-290742 | A | 11/1993 |
| JP | 2776419 | B2 | 5/1998 |
| JP | 11-344952 | A | 12/1999 |
| JP | 2001-272944 | A | 10/2001 |
| KR | 1997-062226 | A | 3/1997 |
| KR | 2001-097044 | A | 11/2001 |

* cited by examiner

*Primary Examiner*—Tuyet Thi Vo
(74) *Attorney, Agent, or Firm*—Sughrue Mion, PLLC

(57) ABSTRACT

In a circuit for driving a plasma display panel including a first circuit formed on a scanning substrate for driving a scanning electrode, and a second circuit formed on a common substrate for driving a common electrode, the circuit in accordance with the present invention is characterized by including a single substrate in place of the scanning and common substrates wherein the first and second circuits are formed on the single substrate.

21 Claims, 26 Drawing Sheets

① PRIMING PERIOD ② PRIMING-ERASING PERIOD
③ SCANNING PERIOD ④ SUSTAINING PERIOD
⑤ SUSTAINING-ERASING PERIOD

FIG.21A
PRIOR ART
FIG.21B
CONVENTIONAL
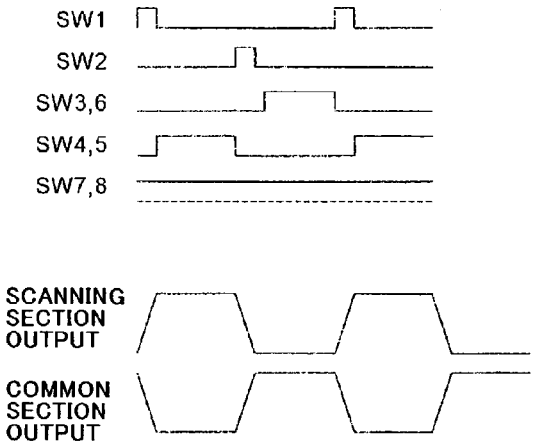
FIRST EMBODIMENT
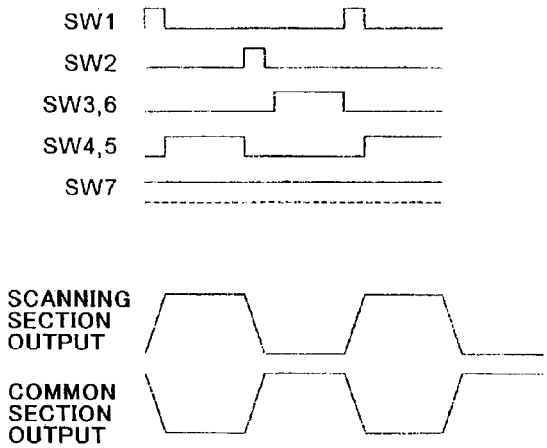

CIRCUIT FOR DRIVING PLASMA DISPLAY PANEL

BACKGROUND OF THE INVENTION

1. Field of the Invention

The invention relates to a circuit for driving a plasma display panel.

2. Description of the Related Art

A plasma display panel has the following advantages in comparison with other displays, and hence, is broadly used in a field of a large-scale outdoor display unit or a large-scale television set.

(a) A plasma display panel can be formed thinner.

(b) A plasma display panel provides a greater display contrast ratio.

(c) A plasma display panel can be readily designed to have a larger screen.

(d) A plasma display panel has a higher response speed.

(e) A plasma display panel emits a light by itself. Hence, it would be possible to emit lights in a plurality of colors through the use of fluorescent materials.

Many plasma display panels have been conventionally suggested, for instance, in Japanese Patent Application Publication No. 5-290742.

FIG. 1 is a perspective view of a conventional plasma display panel 200.

The plasma display panel 200 is designed to include an electrically insulating front substrate 201*a* and an electrically insulating rear substrate 201*b*.

On the front substrate 201*a* are arranged scanning electrodes 209 and common electrodes 210 spaced away from each other by a certain distance in parallel with each other.

Each of the scanning electrodes 209 and each of the common electrodes 210 are comprised of a bus electrode 203 having electrical conductivity and a principal discharge electrode 202 formed on the bus electrode 203 and used for generating discharge. The principal electrode 202 is composed of transparent material such as ITO (indium tin oxide) in order to prevent reduction in transmissivity.

The scanning electrodes 209 and the common electrodes 210 are covered with a dielectric layer 204*a*. A protection layer 205 composed of magnesium oxide is formed on the dielectric layer 204*a* for protecting the dielectric layer 204*a* from discharge.

On the rear substrate 201*b* are arranged a plurality of data electrodes 206 in parallel with one another such that the data electrodes 206 extend perpendicularly to the scanning electrode 209 and the common electrode 210.

Cells are arranged at intersections at which, when viewed vertically, the scanning electrode 209 or the common electrode 210 intersects with the data electrode 206.

The data electrodes 206 are covered with a dielectric layer 204*b*. A plurality of partition walls 207 is formed on the dielectric layer 204*b* to define discharge spaces. The partition walls 207 extend in parallel with the data electrodes 206.

Phosphor 208 is coated on an exposed surface of the dielectric layer 204*b* and sidewalls of the partition walls 207. The phosphor 208 converts ultra-violet ray generated in discharge, into a visible light. For instance, red (R), green (G) and blue (B) phosphors are coated in every three cells.

Discharge gas is hermetically introduced into the discharge spaces sandwiched between the front substrate 201*a* and the rear substrate 201*b* and partitioned by the partition walls 207.

FIG. 2 is a plan view of a conventional driver circuit 90 for driving the plasma display panel 200.

The plasma display panel 200 has a front surface through which a light passes towards a user, and a rear surface 109*a* which is a lower surface of the rear substrate 201*b*. As mentioned below, several circuits are arranged above the rear surface 109*a*.

The driver circuit 90 is formed above the rear surface 109*a* of the plasma display panel 200. The driver circuit 90 is comprised of a common substrate 100, a scanning substrate 101, a relay substrate 111 which mechanically connects the common substrate 100 and the scanning substrate 101 to each other and to which electric charges are collected, data drivers 107, and scanning drivers 108. On the common substrate 100 are formed a sub-scanning block 102 and a sustaining block 103, and on the scanning substrate 101 are formed a priming block 104, a scanning block 105, and a sustaining block 106.

FIG. 3 is a circuit diagram of the driver circuit 90 illustrated in FIG. 2.

The scanning electrode 209 is controlled in operation in accordance with signals transmitted from the scanning drivers 108, and the scanning drivers 108 are controlled in operation by a scanning electrode driving circuit comprised of the priming block 104, the scanning block 105 and the sustaining block 106. The common electrode 210 is controlled in operation by a common electrode driving circuit comprised of the sub-scanning block 102 and the sustaining block 103.

The data electrodes 206 are controlled in operation in accordance with signals transmitted from the data drivers 107.

On the scanning substrate 101 is formed a first circuit for collecting electric charges as well as the scanning electrode driving circuit. On the common substrate 100 is formed a second circuit for collecting electric charges as well as the common electrode driving circuit.

As discharges are generated in the plasma display panel 200, electrical charges are accumulated on the plasma display panel 200. The electric charges accumulated on the plasma display panel 200 are transferred to the relay substrate 111 through the first and second circuits, and collected in capacitors formed on the relay substrate 111.

The conventional driver circuit 90 illustrated in FIGS. 2 and 3 are accompanies with problems as follows.

FIG. 4 is a plan view of the conventional driver circuit 90, showing the first problem of the driver circuit 90.

In the conventional driver circuit 90 illustrated in FIG. 2, since the common substrate 100 and the scanning substrate 101 are formed separately from each other, a heat sink 100*a* or 101*a* is also formed in each of the common substrate 100 and the scanning substrate 101. Herein, a heat sink means a part of a switch which generates heat. A principal heat sink is the sustaining blocks 103 and 106.

Since the heat sink 100*a* formed on the common substrate 100 and the heat skink 101*a* formed on the scanning substrate 101 generate heat in different amounts, it was not possible to keep switch elements formed on the common and scanning substrates 100 and 101 at the same temperature. As a result, a difference in temperature is generated among switch elements, causing a difference in delay among drive signals.

In addition, since the heat sinks 100*a* and 101*a* generate heat at different timing, it was necessary for the conventional driver circuit 90 to include two heat radiator s for the heat sinks 100*a* and 101*a*. Such two heat radiator s caused problems of an increase in the number of fabrication steps and an increase in a space necessary for the driver circuit 90 to be formed.

Furthermore, a difference in temperature between the common and scanning substrates 100 and 101 caused variance in CR time constant in accordance with which clamp timing was determined. Thus, clamp timing at which electric charges were collected was inaccurately determined, resulting in that it was not possible to effectively collect electric charges.

FIG. 5 is a plan view of the conventional driver circuit 90, showing the second problem of the driver circuit 90.

In the conventional driver circuit 90, as illustrated in FIG. 5, a sustaining current 110 runs at a ground (GND) line of a module plate. Since the common and scanning substrates 100 and 101 are arranged at opposite ends of the plasma display panel 200, the sustaining current runs in a long path, resulting in generation of high EMI noises.

FIG. 6 is a plan view of the conventional driver circuit 90, showing the third problem of the driver circuit 90.

As mentioned above, the common substrate 100 and the scanning substrate 101 were mechanically connected to each other through the relay substrate 111 in the conventional driver circuit 90. The relay substrate 111 collects electric charges accumulated in charge-collection circuits arranged on the common and scanning substrates 100 and 101. The relay substrate 111 is designed to have an inductance 112 in order to collect electric charges.

However, the inductance 112 causes problems that a wiring length is increased and accordingly a resistance 112*a* is increased with the result of an increase in a loss of the driver circuit 90.

FIG. 7 is a plan view of the conventional driver circuit 90, showing the fourth problem of the driver circuit 90.

As illustrated in FIG. 7, the common substrate 100 and the scanning substrate 101 include both a Vs clamp circuit 113 and a GND clamp circuit 114. In particular in the common substrate 100, the clamp circuits 113 and 114 make it impossible to locate a waveform-shaping Vs slice diode 115 and a waveform-shaping GND slice diode 116 in the vicinity of an edge of the plasma display panel 200.

FIG. 8A illustrates a desired waveform of a signal output from the driver circuit 90, and FIG. 8B illustrates an actual waveform of a signal output from the driver circuit 90. FIG. 9 is a graph showing a relation between a voltage at which the plasma display panel 200 is driven and the above-mentioned desired and actual waveforms.

As illustrated in FIG. 8B, overshoots occur in the actual waveform due to parasitic inductance of the common substrate 100. This is because the Vs slice diode 115 and the GND slice diode 116 cannot be located in the vicinity of an edge of the plasma display panel 200.

As a result, as illustrated in FIG. 9, a voltage Vw at which a light is wrongly emitted reduces to a degree of the overshoot, and hence, a range Ra of a driving voltage for the actual waveform is reduced in comparison with the same Rd for the desired waveform (driving margin).

Japanese Patent No. 2776419 (Japanese Patent Application Publication No. 9-179521) has suggested a driver circuit for driving a planar display unit including at least one pair of electrodes and panel capacity associated therewith. The driver circuit includes a first path through which a voltage having been applied to the electrodes escapes, a second path through which a voltage is applied to the electrodes, and a capacitor electrically connected to the first and second paths. The first path is comprised of a first coil, a first diode having an anode located close to the electrodes, and a first switch. The second path is comprised of a second coil, a second diode having a cathode located close to the electrodes, and a second switch. The driver circuit further includes a first clamping unit electrically connected between the electrodes and the first coil in the first path, and applying a low voltage to the first path, and a second clamping unit electrically connected between the electrodes and the second coil in the second path, and applying a high voltage to the second path.

Japanese Patent Application Publication No. 11-344952 has suggested a circuit for driving a display unit including a plurality of pairs of control and sustaining electrodes. The circuit includes a sustaining circuit which applies a voltage alternately to the control electrode and the sustaining electrode, and a control circuit. The sustaining circuit is comprised of first and second switching elements electrically connected in series to opposite ends of a capacitor formed between the control and sustaining electrodes, a resonant coil electrically connected in series between the first and second switching elements, and two switching elements electrically connected in series between a power supply line and a ground line. A node to which the two switching elements are electrically connected is electrically connected to a node to which coils of the first and second switching elements are not electrically connected. The control circuit controls the switching elements.

Japanese Patent Application Publication No. 2001-272944 has suggested a circuit for driving a plasma display panel, including a first sustaining driver circuit which controls a voltage of a scanning electrode, and raises a voltage of the sustaining electrode by virtue of a power supply voltage when the scanning electrode is at a voltage of the power supply voltage, a second sustaining driver circuit which controls a voltage of a sustaining electrode, and raises a voltage of the scanning electrode by virtue of a power supply voltage when the sustaining electrode is at a voltage of the power supply voltage, and a relay circuit through which the first and second sustaining driver circuits are electrically connected to each other.

SUMMARY OF THE INVENTION

In view of the above-mentioned problems in the conventional driver circuit for driving a plasma display panel, it is an object of the present invention to provide a circuit for driving a plasma display panel which circuit is capable of solving problems caused by a difference in both heat and timing at which heat is generated, between common and scanning substrates, preventing generation of EMI noises caused by a sustaining current running at a ground line in a module plate, preventing circuit loss caused by an inductance, and preventing generation of overshoot in a waveform of an output signal.

In one aspect of the present invention, there is provided a circuit for driving a plasma display panel, including (a) a first circuit formed on a scanning substrate for driving a scanning electrode, and (b) a second circuit formed on a common substrate for driving a common electrode, characterized in that the circuit includes a single substrate in place of the scanning and common substrates wherein the first and second circuits are formed on the single substrate.

There is further provided a circuit for driving a plasma display panel, including (a) a first circuit formed on a scanning substrate for driving a scanning electrode, the first circuit including a third circuit for collecting electric charges, the third circuit including a first capacitor for accumulating electric charges therein, and (b) a second circuit formed on a common substrate for driving a common electrode, the second circuit including a fourth circuit for collecting electric charges, the fourth circuit including a second capacitor for accumulating electric charges therein, characterized in that the circuit includes a single substrate in place of the scanning and common substrates wherein the first and second circuits are formed on the single substrate, and further includes a single capacitor for accumulating electric charges therein, in place of the first and second capacitors.

There is still further provided a circuit for driving a plasma display panel, including (a) a first circuit formed on a scanning substrate for driving a scanning electrode, (b) a second circuit formed on a common substrate for driving a common electrode, and (c) a third circuit formed on a relay substrate for collecting electric charges, the relay substrate connecting the scanning and common substrates to each other therethrough, the circuit including a single substrate in place of the scanning, common and relay substrates wherein the first and second circuits are formed on the single substrate, the circuit further including a connector substrate arranged facing a rear surface of the plasma display panel, the single substrate being arranged facing a rear surface of the plasma display panel, the single substrate being electrically connected at one end thereof to the plasma display panel at one of ends of the plasma display panel, and further electrically connected at the other end thereof to the plasma display panel at the other end of the plasma display panel through the connector substrate.

For instance, the connector substrate may be comprised of a first substrate arranged facing the other end of the plasma display panel, and a second substrate mechanically and electrically connecting the single substrate and the first substrate to each other.

The circuit may further include a ground line formed on the single substrate for electrically connecting a first clamp circuit associated with the first circuit and a second clamp circuit associated with the second circuit to each other.

The circuit may further include a waveform-shaping slice diode.

The circuit may further include a Vs reverse circuit used commonly by the first and second circuits.

The circuit may further include a Vs clamp circuit used commonly by the first and second circuits.

The advantages obtained by the aforementioned present invention will be described hereinbelow.

Firstly, since the driver circuit in accordance with the present invention is designed to include a single substrate 12 in place of a common substrate and a scanning substrate, it is possible to unify a plurality of heat sources into one. Specifically, the conventional driver circuit had to include two sustaining blocks, one of them in a common substrate and the other in a scanning substrate, but the present invention unifies the two sustaining blocks into one.

In addition, since common and scanning substrates generate heat in different timing, the driver circuit can be designed to have only one heat radiator for both common and scanning substrates.

Since scanning and common sections are kept at almost the same temperature in the driver circuit in accordance with the present invention, it is possible to avoid variance in CR time constant in accordance with which clamp timing is determined, and hence, variance in clamp timing.

Secondly, since a ground line is formed on the single substrate, it is possible to shorten a ground line, and hence, reduce EMI noises.

Thirdly, the unification of two substrates into one brings advantages of concentration of inductance, reduction in a length of a pattern path, and reduction in EMI noises.

Fourthly, it is possible to locate a waveform-shaping slice diode in the vicinity of a display panel.

As a result, it is possible to cut overshoot caused by parasitic inductance of the single substrate, by means of the slice diode, ensuring that a waveform of an output signal can be made similar to a desired waveform. Thus, a range of a drive voltage (drive margin) can be broadened.

Fifthly, the number of switching elements in a Vs reverse circuit can be reduced by one, and the number of switching elements in a Vs clamp circuit can be reduced by one, ensuring simplification of a structure of the driver circuit and reduction in fabrication cost of the driver circuit.

The above and other objects and advantageous features of the present invention will be made apparent from the following description made with reference to the accompanying drawings, in which like reference characters designate the same or similar parts throughout the drawings.

BRIEF DESCRIPTION OF THE DRAWINGS

FIG. 21A is a signal chart showing an operation of a conventional driver circuit for driving a plasma display panel.

FIG. 21B is a signal chart showing an operation of the driver circuit for driving a plasma display panel, in accordance with the first embodiment.

DESCRIPTION OF THE PREFERRED EMBODIMENTS

Preferred embodiments in accordance with the present invention will be explained hereinbelow with reference to drawings.

First Embodiment

Figure 10:
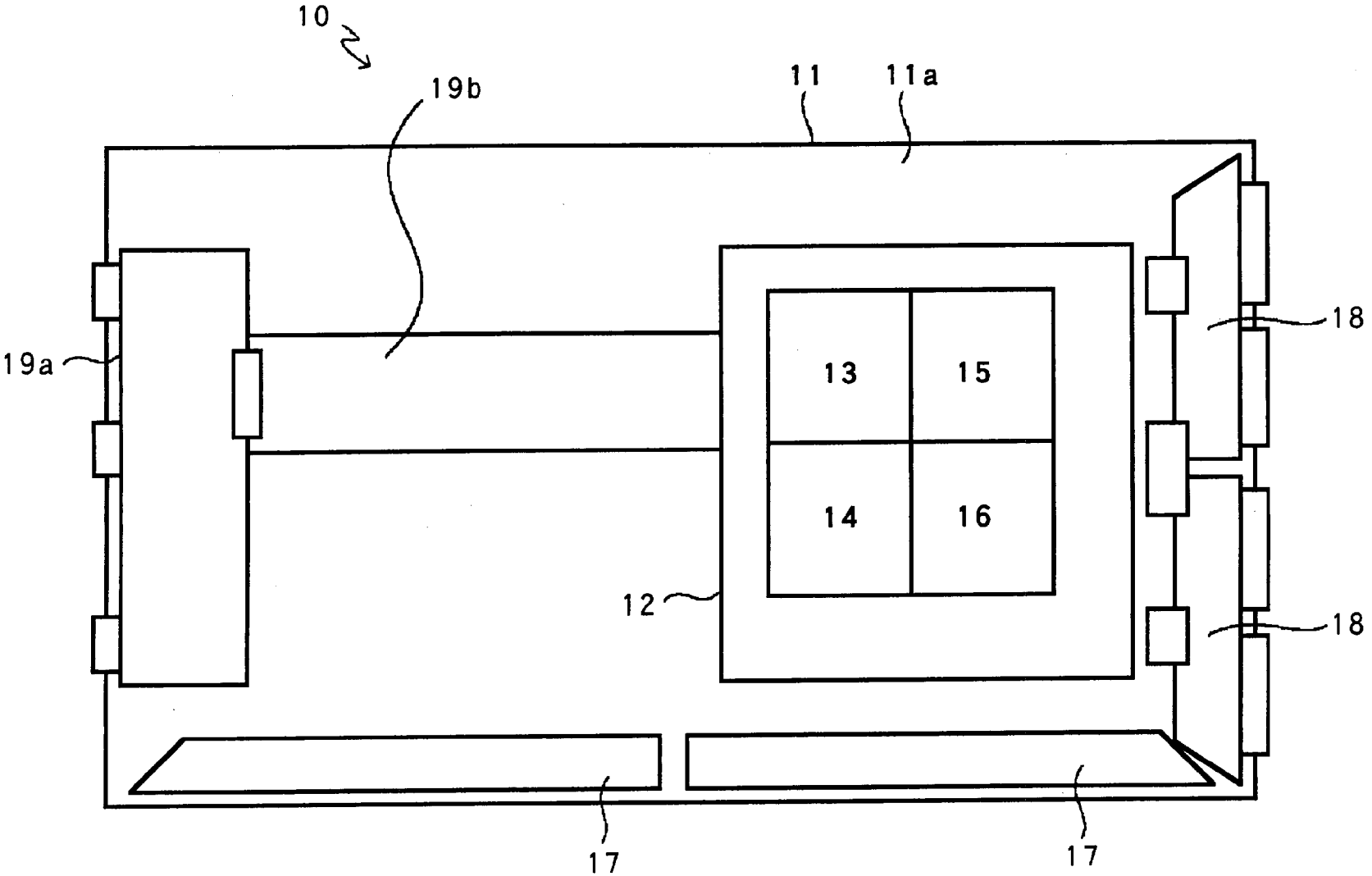
FIG. 10 is a plan view of a driver circuit for driving a plasma display panel, in accordance with the first embodiment of the present invention.

FIG. 10 is a plan view of a driver circuit 10 for driving a plasma display panel, in accordance with the first embodiment.

The driver circuit 10 is comprised of a single substrate 12 arranged facing a rear surface 11*a* of a display panel 11, a sub-scanning block 13, a sustaining block 14, a priming block 15 and a scanning block 16 all formed on the substrate 12, data drivers 17, scanning drivers 18, a first relay substrate 19*a*, and a second relay substrate 19*b*.

The substrate 12 is located in the vicinity of an edge of the display panel 11 closer to the scanning drivers 18, and is electrically connected to the display panel 11 at the other edge thereof through the second and first relay substrates 19*b* and 19*a*.

Figure 1:
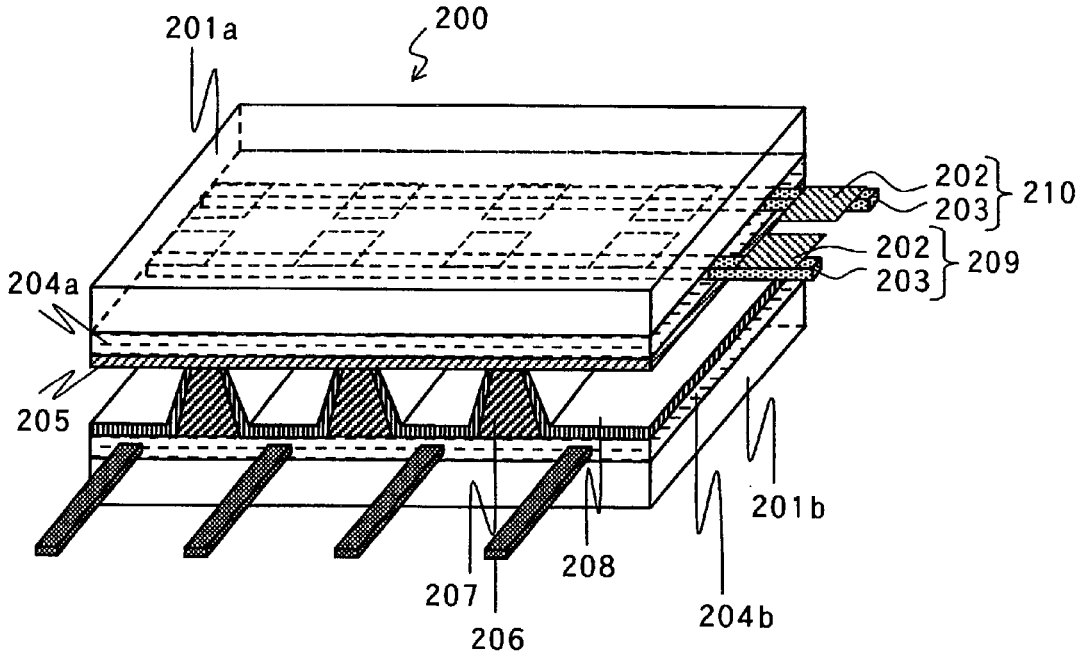
FIG.1 PRIOR ART
FIG. 1 is a perspective view of a conventional plasma display panel 200.
Figure 2:
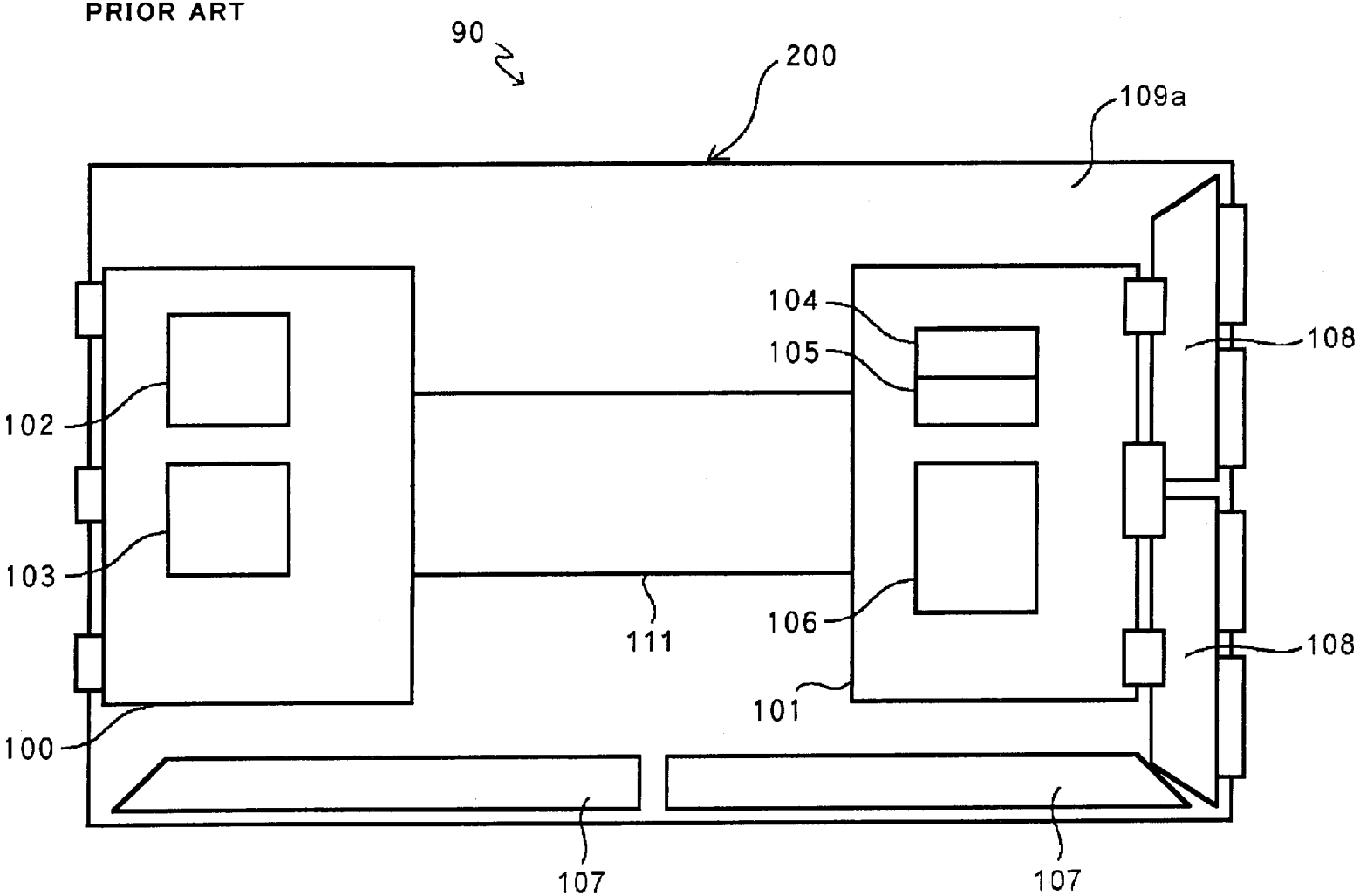
FIG.2 PRIOR ART
FIG. 2 is a plan view of a conventional driver circuit for driving the plasma display panel illustrated in FIG. 1.
Figure 3:
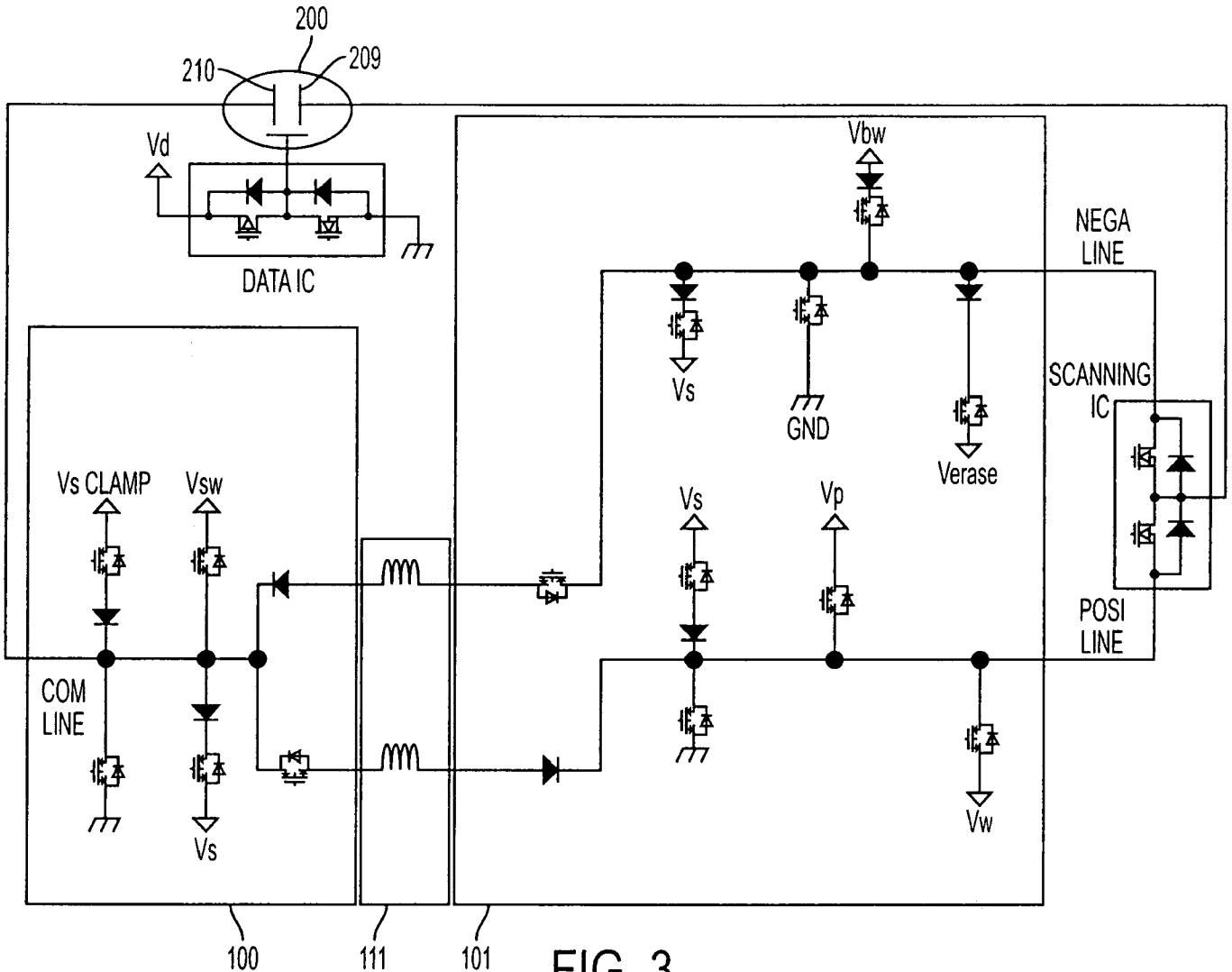
FIG. 3 PRIOR ART
FIG. 3 is a circuit diagram of the driver circuit illustrated in FIG. 2.
Figure 4:
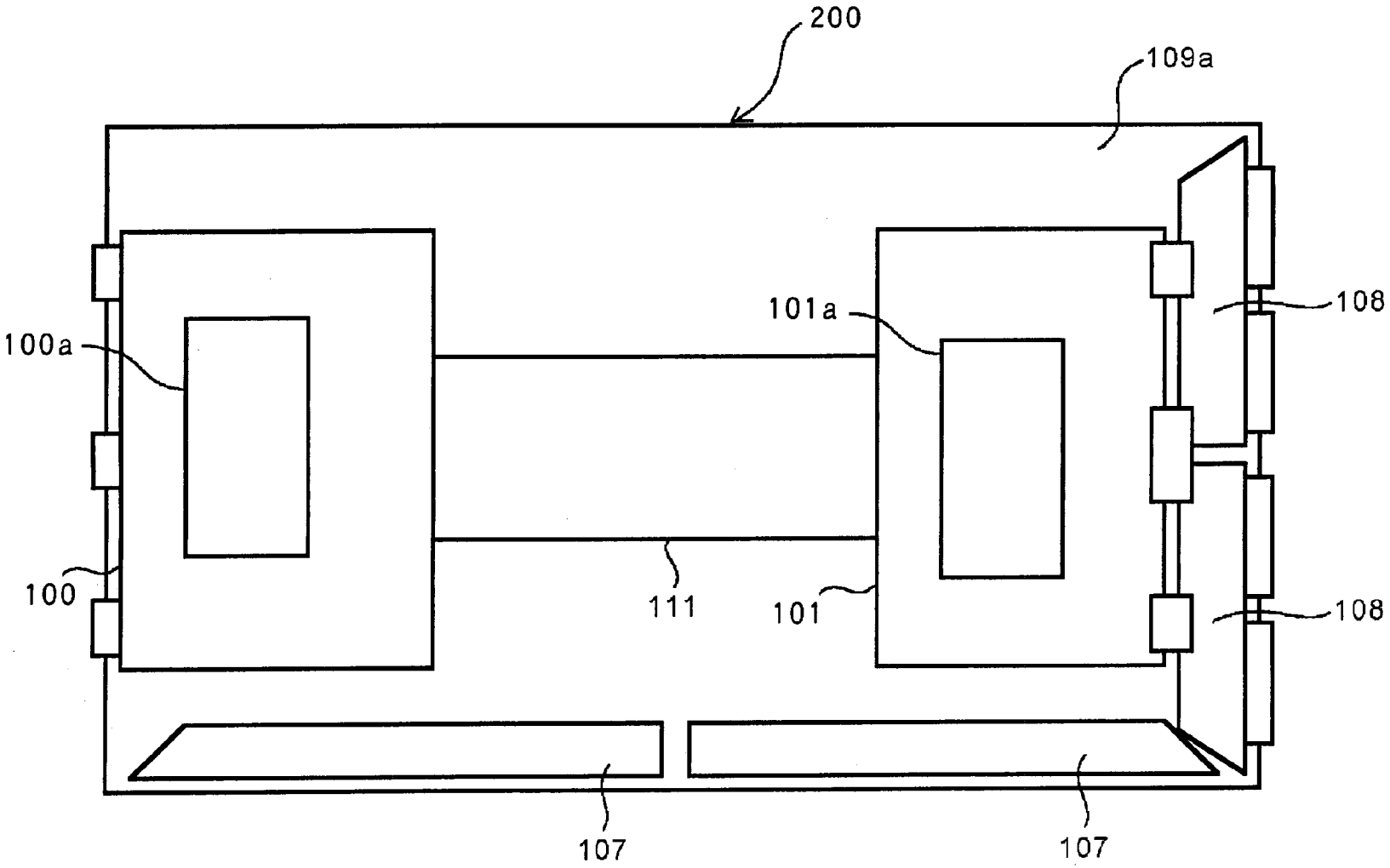
FIG.4 PRIOR ART
FIG. 4 is a plan view of the conventional driver circuit illustrated in FIG. 2, showing the first problem of the driver circuit.

An inductance for collecting electric charges or similar parts is not mounted on the first and second relay substrates 19*a* and 19*b* unlike the relay substrate illustrated in FIG. 2.

Figure 11:
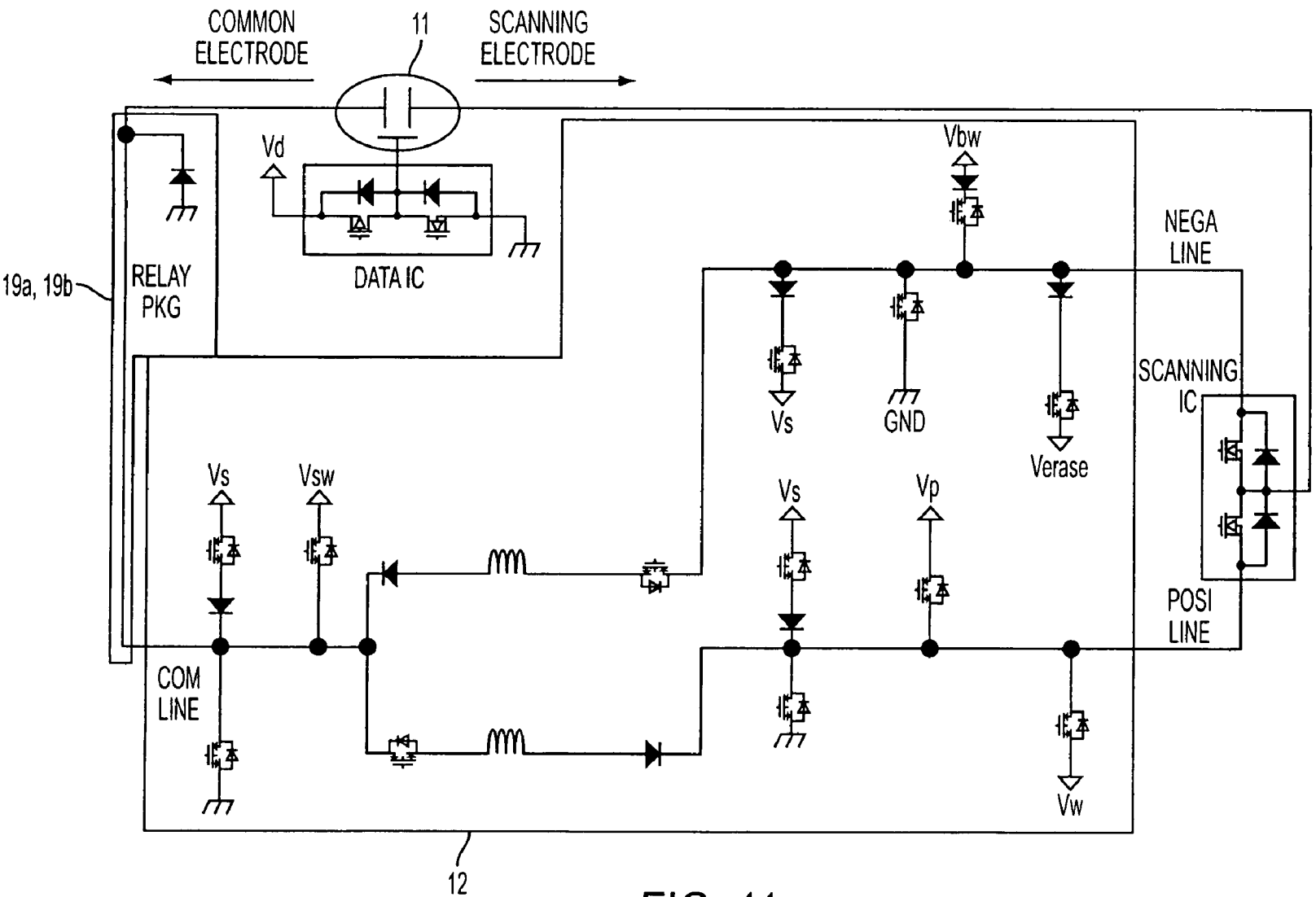
FIG. 11 is a circuit diagram of the driver circuit illustrated in FIG. 10.
Figure 12:
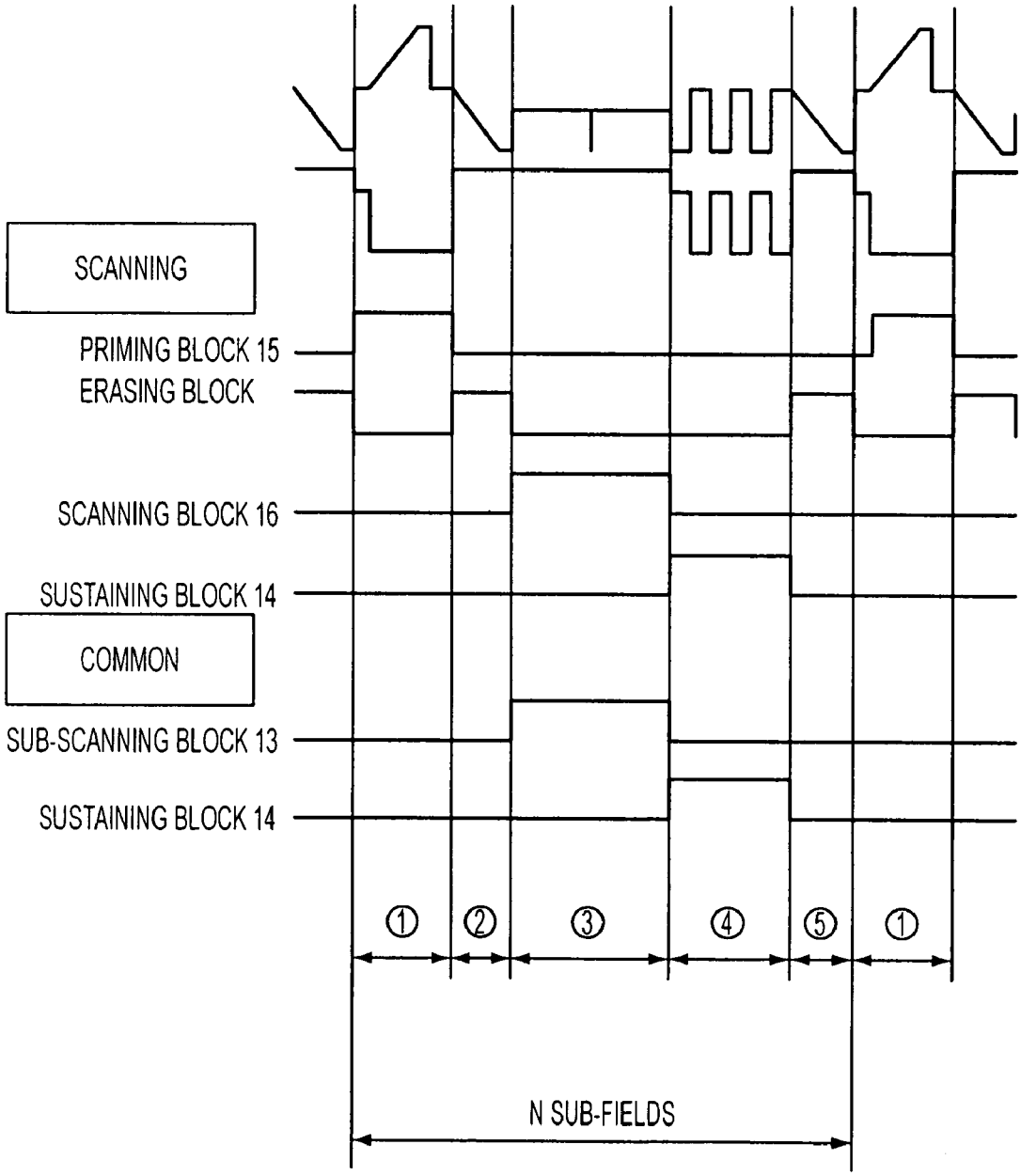
FIG. 12 illustrates waveforms of signals produced in the driver circuit illustrated in FIG. 10.

FIG. 11 is a circuit diagram of the driver circuit 10. FIG. 12 is a signal chart showing whether the priming block 15, an erasing block (not illustrated in FIG. 10), the scanning block 16 and the sustaining block 14 all of which constitute a circuit associated with a scanning substrate are on or off, and further showing whether the sub-scanning block 13 and the sustaining block 14 both of which constitute a circuit associated with a common substrate are on or off. Herein, the sustaining block 14 is a part of both of the circuits associated with scanning and common substrates. These blocks are turned on or off in each of a priming period, a priming-erasing period, a scanning period, a sustaining period and a sustaining-erasing period.

In comparison with the conventional driver circuit 90 illustrated in FIG. 2, the driver circuit 10 in accordance with the first embodiment includes the substrate 12 corresponding to both of the common substrate 100 and the scanning substrate 101, in place of the common substrate 100 and the scanning substrate 101, and accordingly, the circuits having been formed on the common substrate 100 and the scanning substrate 101 are now formed on the substrate 12.

The driver circuit 10 provides the following advantages in comparison with the conventional driver circuit 90 illustrated in FIG. 2.

Figure 13:
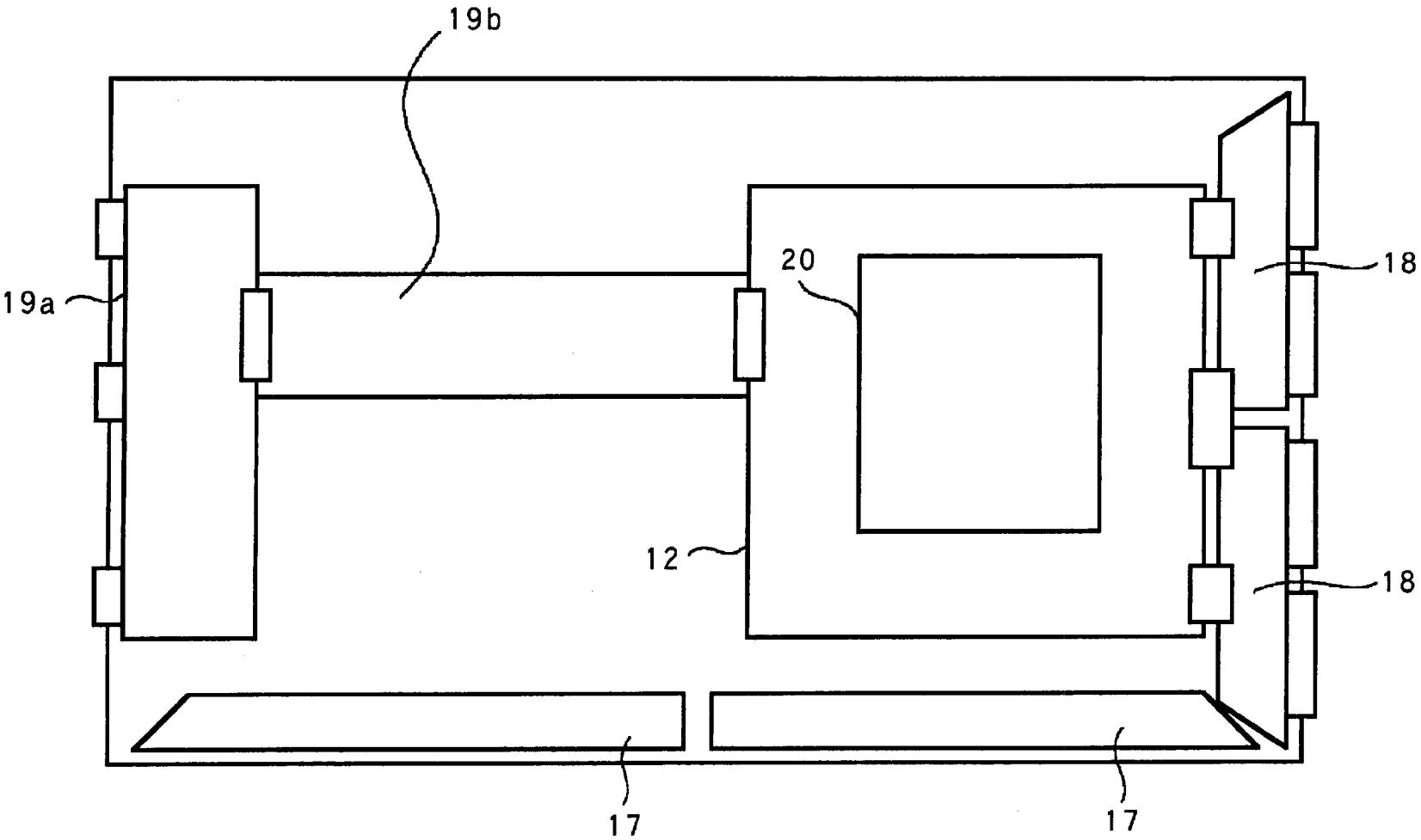
FIG. 13 is a plan view of the driver circuit illustrated in FIG. 10, showing the first advantage provided by the driver circuit.

FIG. 13 shows the first advantage provided by the driver circuit 10.

Since the driver circuit 10 is designed to include the single substrate 12 in place of the common substrate 100 and the scanning substrate 101, it would be possible in the driver circuit 10 to unify the two sustaining blocks 103 and 106 necessary for the conventional driver circuit 90 into only one sustaining block 14.

Among parts constituting a driver circuit for driving a plasma display panel, a sustaining block irradiates heat at maximum. Accordingly, the conventional driver circuit 90 in which the sustaining blocks 103 and 106 are formed on the common and scanning substrates 100 and 101, respectively, was necessary to have two heat radiators regardless of a difference in timing at which the sustaining blocks 103 and 106 generate heat.

In contrast, the driver circuit 10 in accordance with the first embodiment has only one sustaining block as a heat sink 20 which is a part generating heat at maximum among parts constituting a switch element. Hence, it is possible to unify a plurality of heat sources into one. Even if a plurality of sustaining blocks is unified into one, since common and scanning substrates generate heat at different timing, it would be possible to absorb the heat generated in both common and scanning substrates, into a single heat radiator. Hence, it is possible to reduce the number of heat radiators from two to one. As a result, a space necessary for arranging a heat radiator can be decreased, ensuring enhancement in designability of a heat radiator.

In addition, since a switching element has no longer a difference in temperature, it is possible to solve the problem of a difference in signal delay caused by a difference in temperature.

Furthermore, the conventional driver circuit 90 unavoidably had variance in CR time constant due to a difference in temperature between the scanning substrate 100 and the common substrate 101. In contrast, since the scanning and common sections are kept at almost the same temperature in the driver circuit 10 in accordance with the first embodiment, it is possible to avoid variance in CR time constant, and hence, variance in clamp timing.

Figure 14:
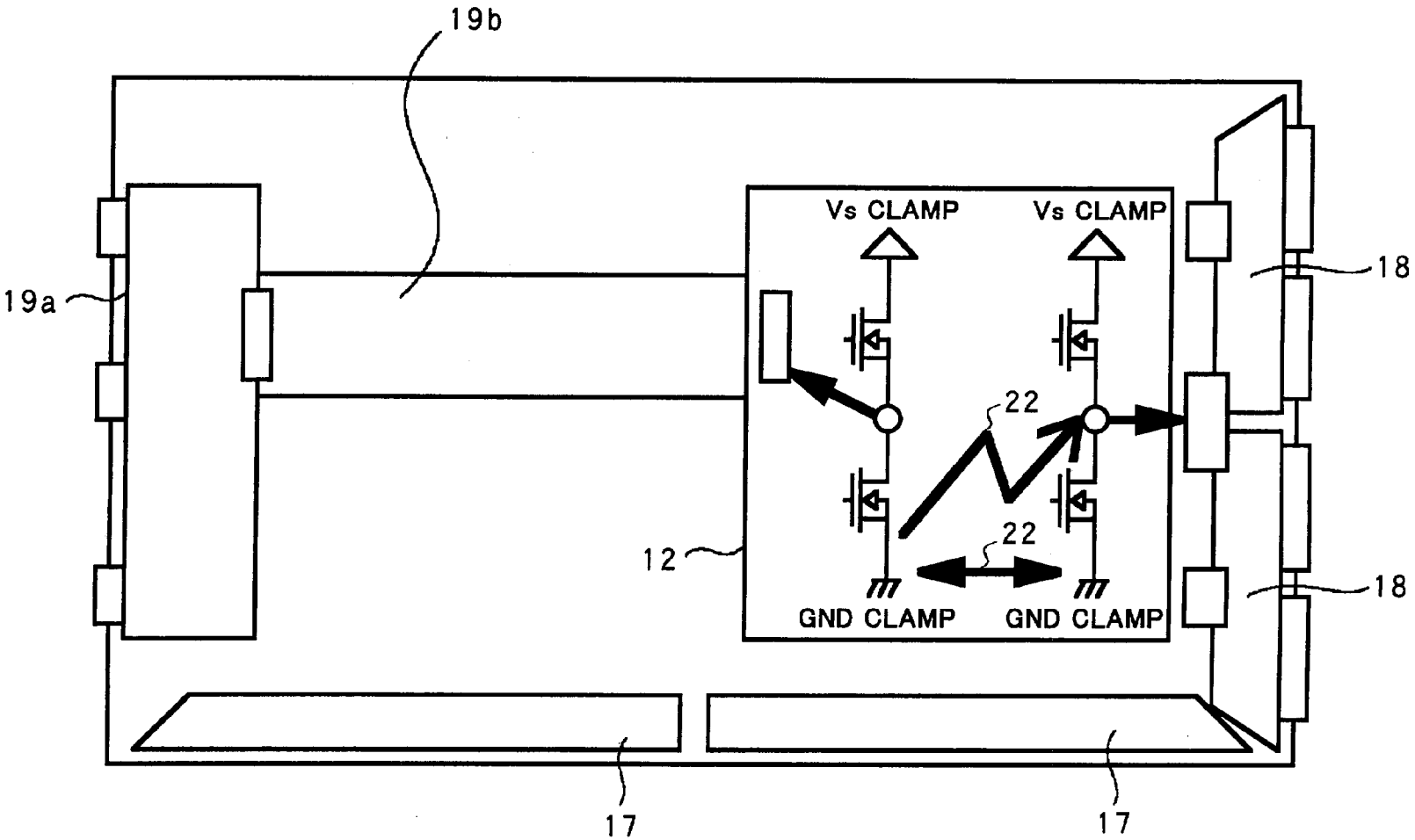
FIG. 14 is a plan view of the driver circuit illustrated in FIG. 10, showing the second advantage provided by the driver circuit.

FIG. 14 shows the second advantage provided by the driver circuit 10.

Figure 5:
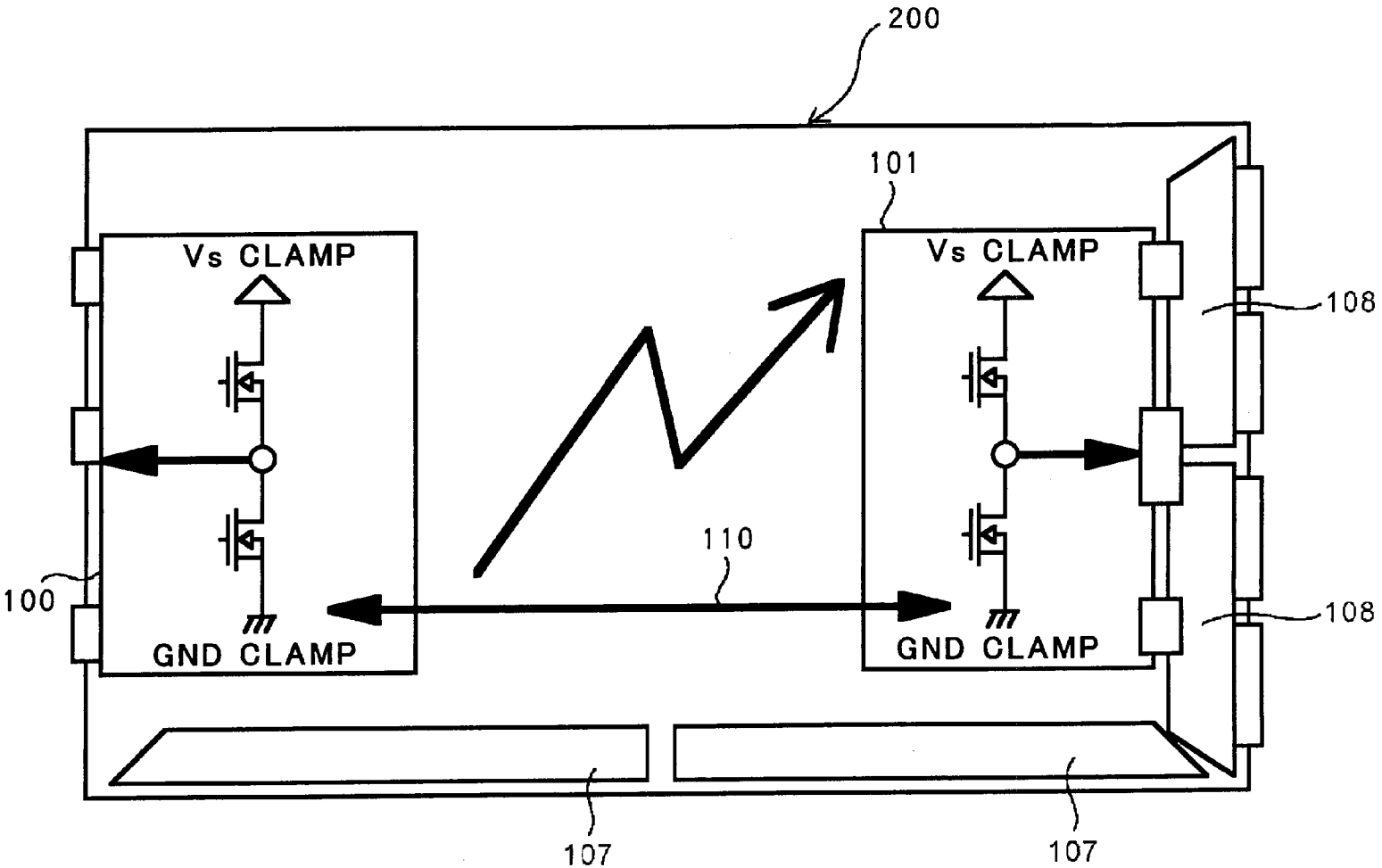
FIG.5 PRIOR ART
FIG. 5 is a plan view of the conventional driver circuit illustrated in FIG. 2, showing the second problem of the driver circuit.
Figure 6:
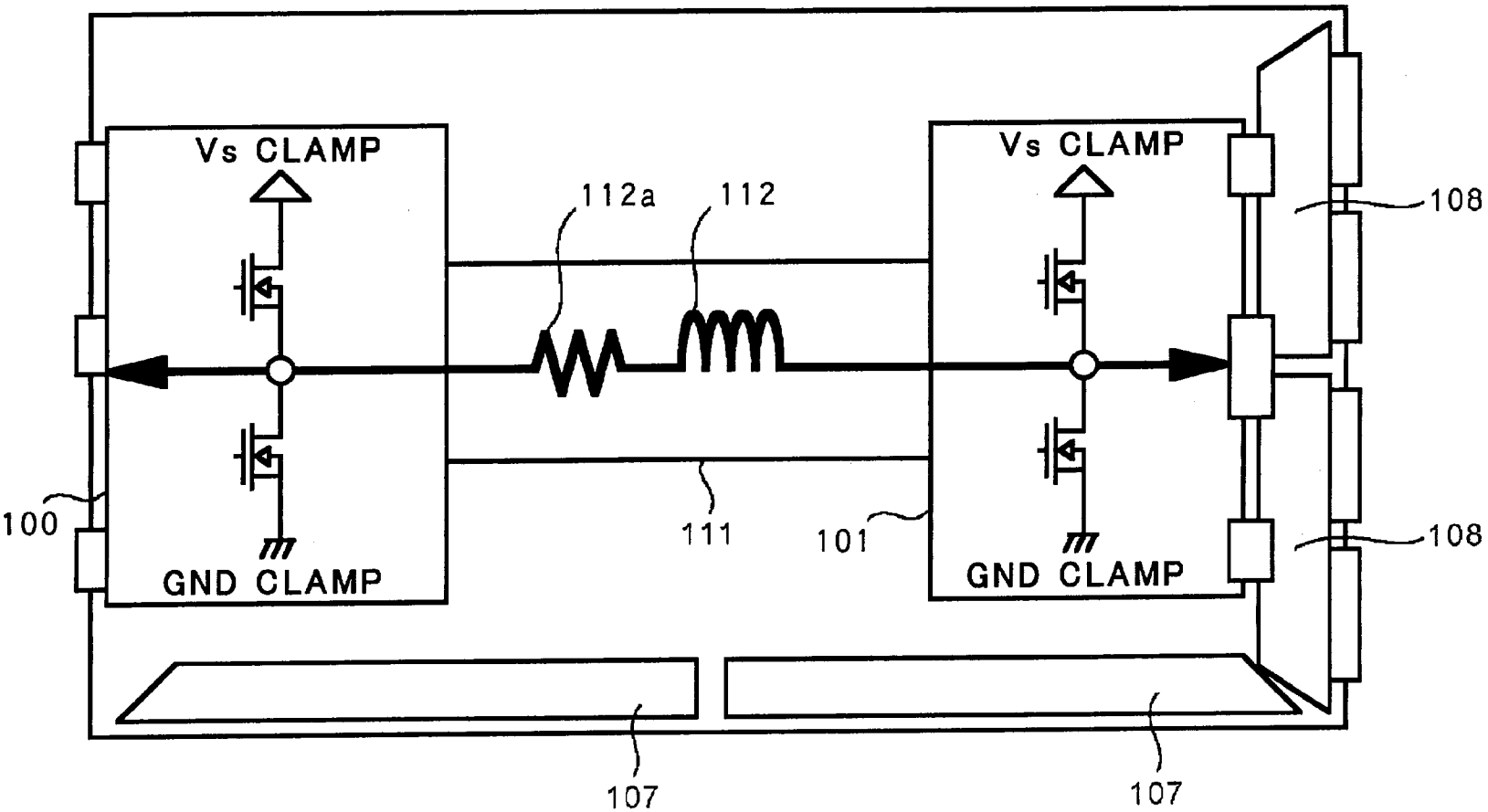
FIG.6 PRIOR ART
FIG. 6 is a plan view of the conventional driver circuit illustrated in FIG. 2, showing the third problem of the driver circuit.
Figure 7:
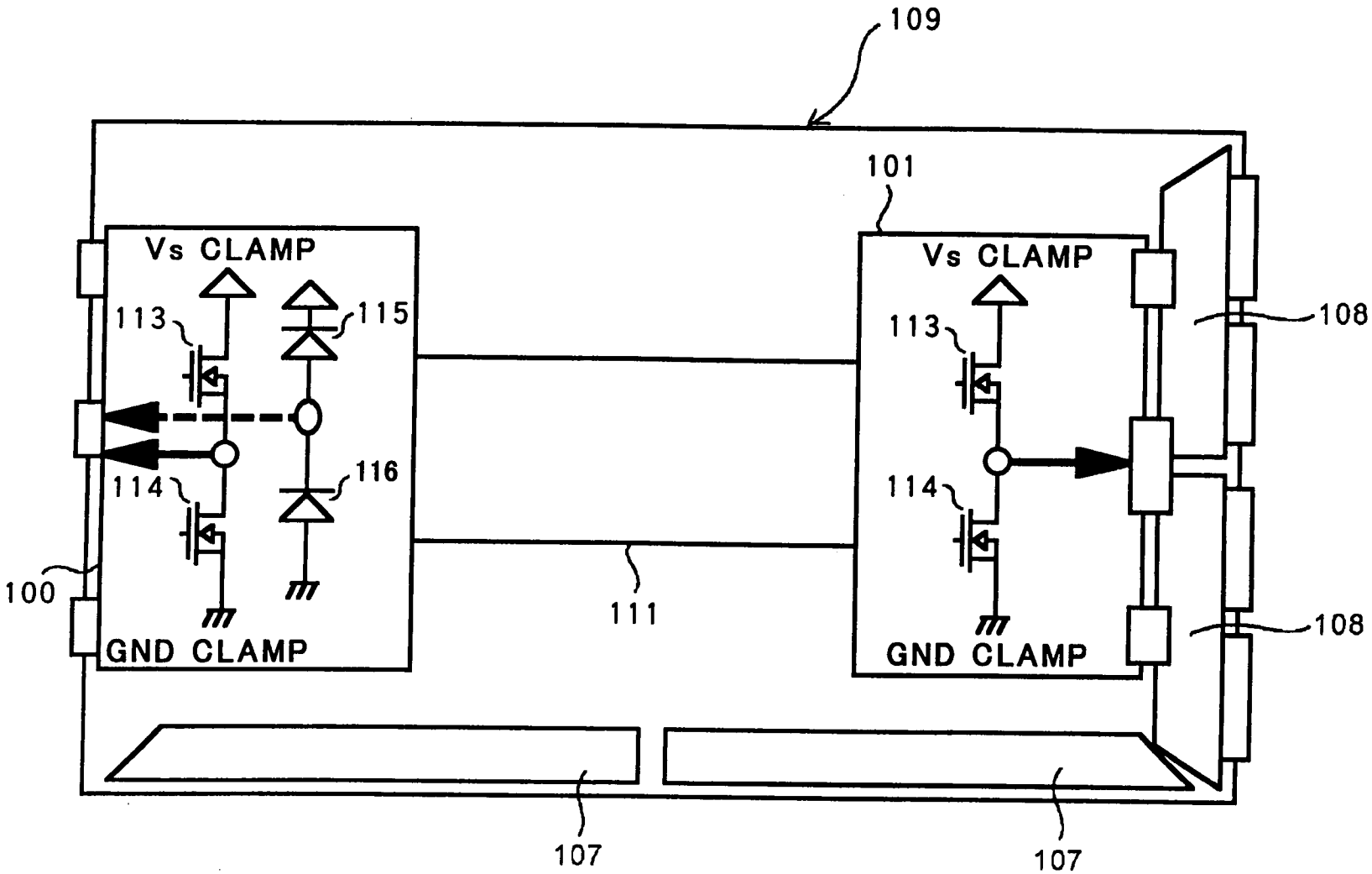
FIG.7 PRIOR ART
FIG. 7 is a plan view of the conventional driver circuit illustrated in FIG. 2, showing the fourth problem of the driver circuit.
Figure 8A:
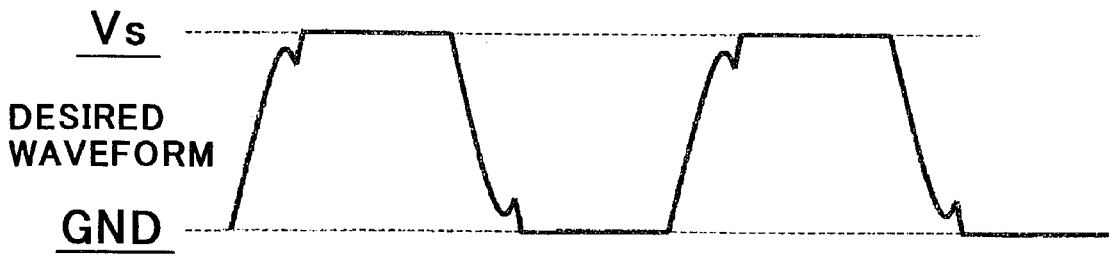
FIG.8A PRIOR ART
FIG. 8A illustrates a desired waveform of a signal output from the driver circuit illustrated in FIG. 2.
Figure 8B:
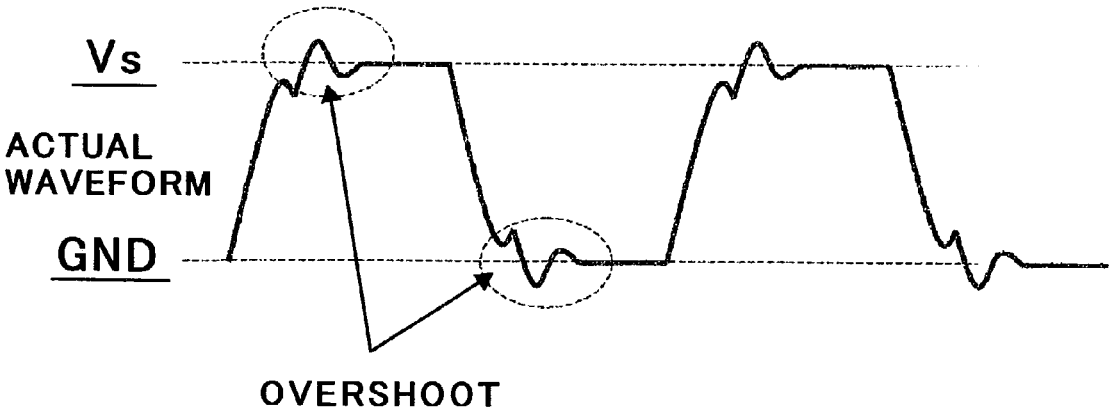
FIG.8B PRIOR ART
FIG. 8B illustrates an actual waveform of a signal output from the driver circuit illustrated in FIG. 2.
Figure 9:
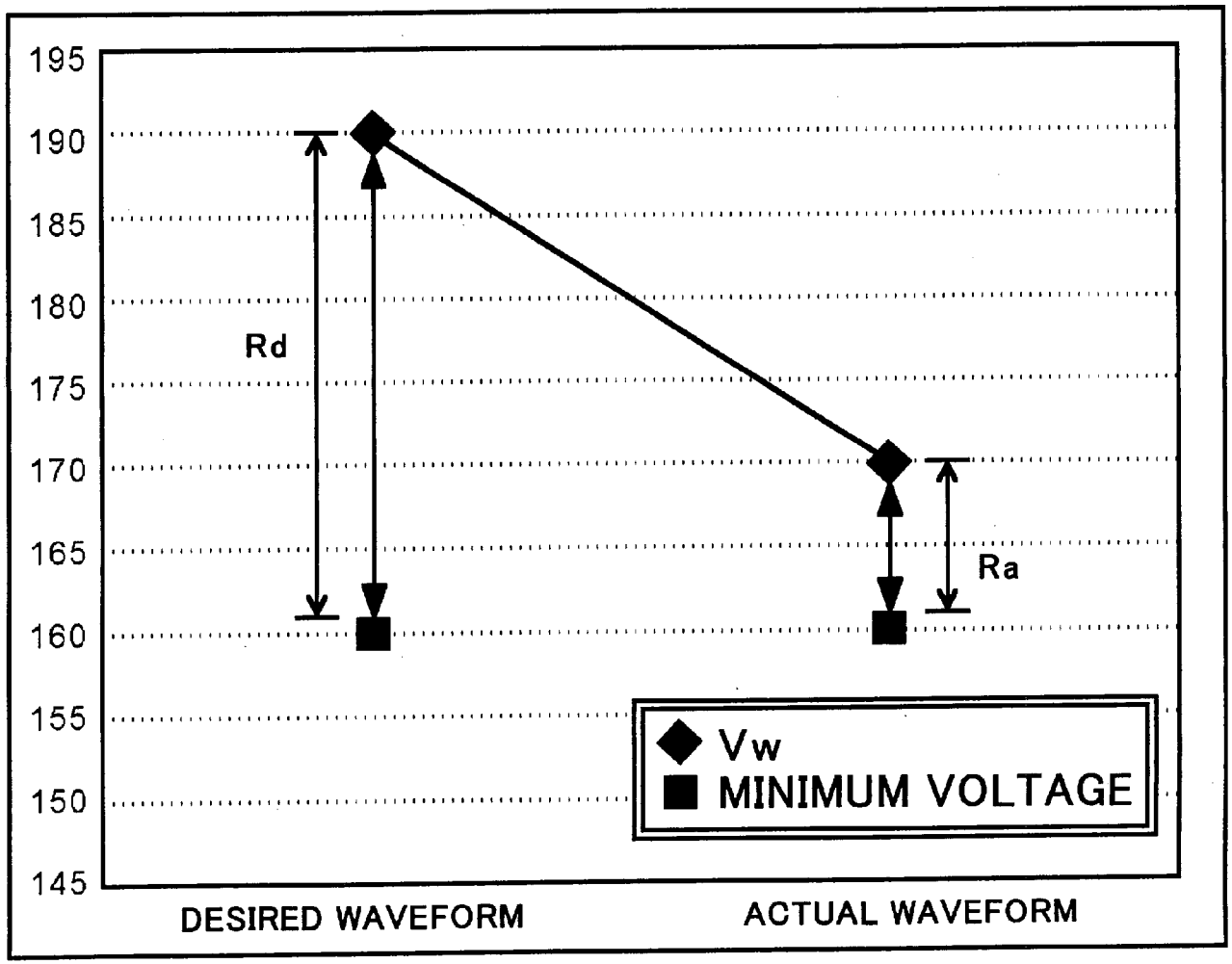
FIG.9 PRIOR ART
FIG. 9 is a graph showing a relation between a voltage at which the plasma display panel illustrated in FIG. 1 is driven and the desired and actual waveforms illustrated in FIGS. 8A and 8B.

In the conventional driver circuit 90, since the sustaining current 110 runs between the common substrate 100 and the scanning substrate 101 by a long length, as illustrated in FIG. 5, high EMI noises were generated.

In contrast, a sustaining current 22 runs only in the substrate 12 in the driver circuit 10 in accordance with the first embodiment. Hence, the sustaining current 22 runs by a short length in comparison with the sustaining current 101, ensuring reduction in EMI noises.

Since the sustaining current 110 runs between the common substrate 100 and the scanning substrate 101 in the conventional driver circuit 90, it was quite difficult to shield EMI noises caused by the sustaining current 110. Since the sustaining current 22 runs only within the substrate 12 in the driver circuit 10 in accordance with the first embodiment, it is possible to shield EMI noises caused by the sustaining current 22, by shielding the substrate 12.

Figure 15:
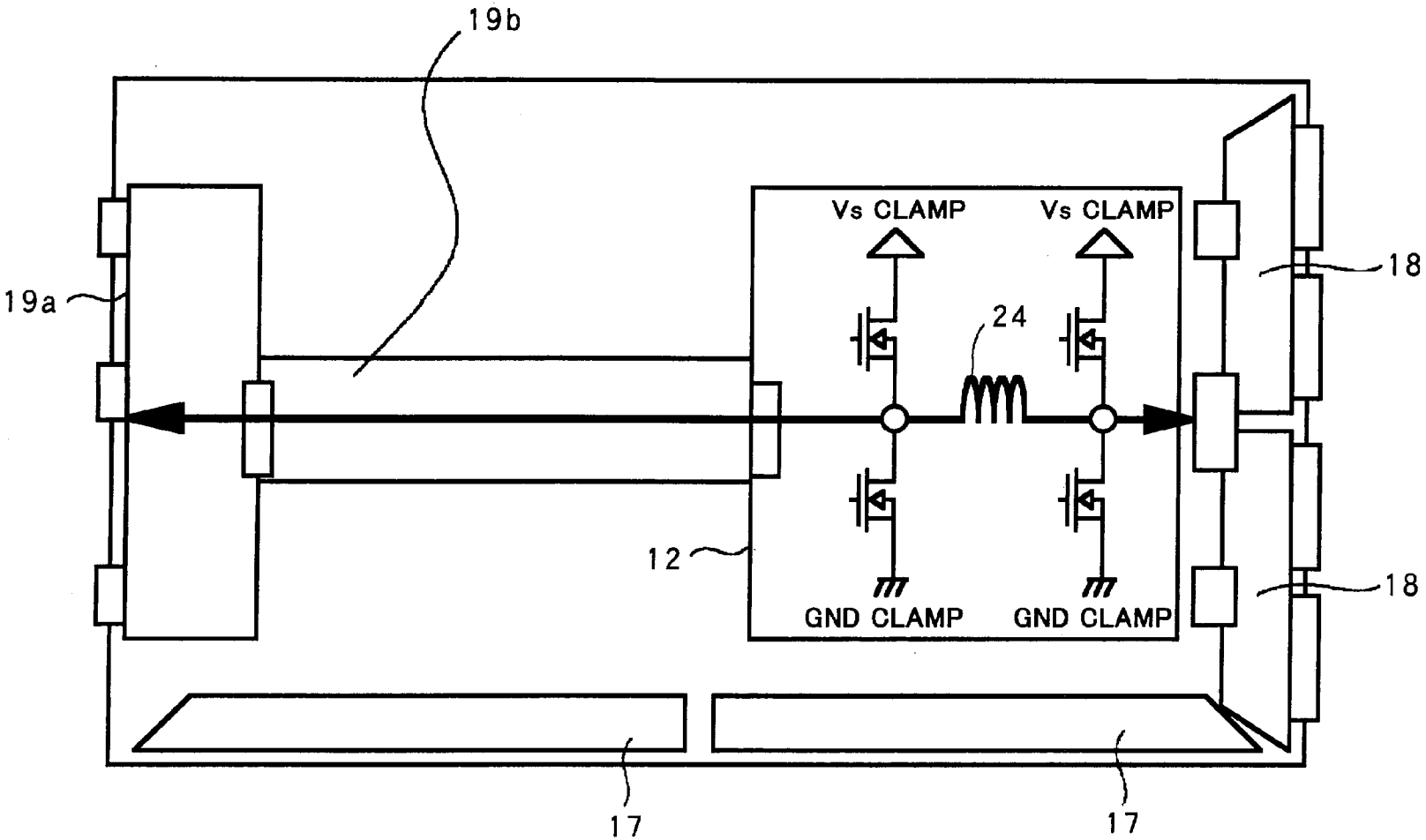
FIG. 15 is a plan view of the driver circuit illustrated in FIG. 10, showing the third advantage provided by the driver circuit.

FIG. 15 shows the third advantage provided by the driver circuit 10.

Since circuits are formed on the single substrate 12 in the driver circuit 10 in accordance with the first embodiment, inductance 24 is inevitably concentrated onto the substrate 12. As a result, it is possible to shorten a length of a pattern path, and reduce pattern loss and hence EMI noises, ensuring enhancement in efficiency at which electric charges are collected.

In particular, it is possible to reduce EMI noises generated around the inductance 24, by concentrating inductance onto the substrate 12.

Figure 16:
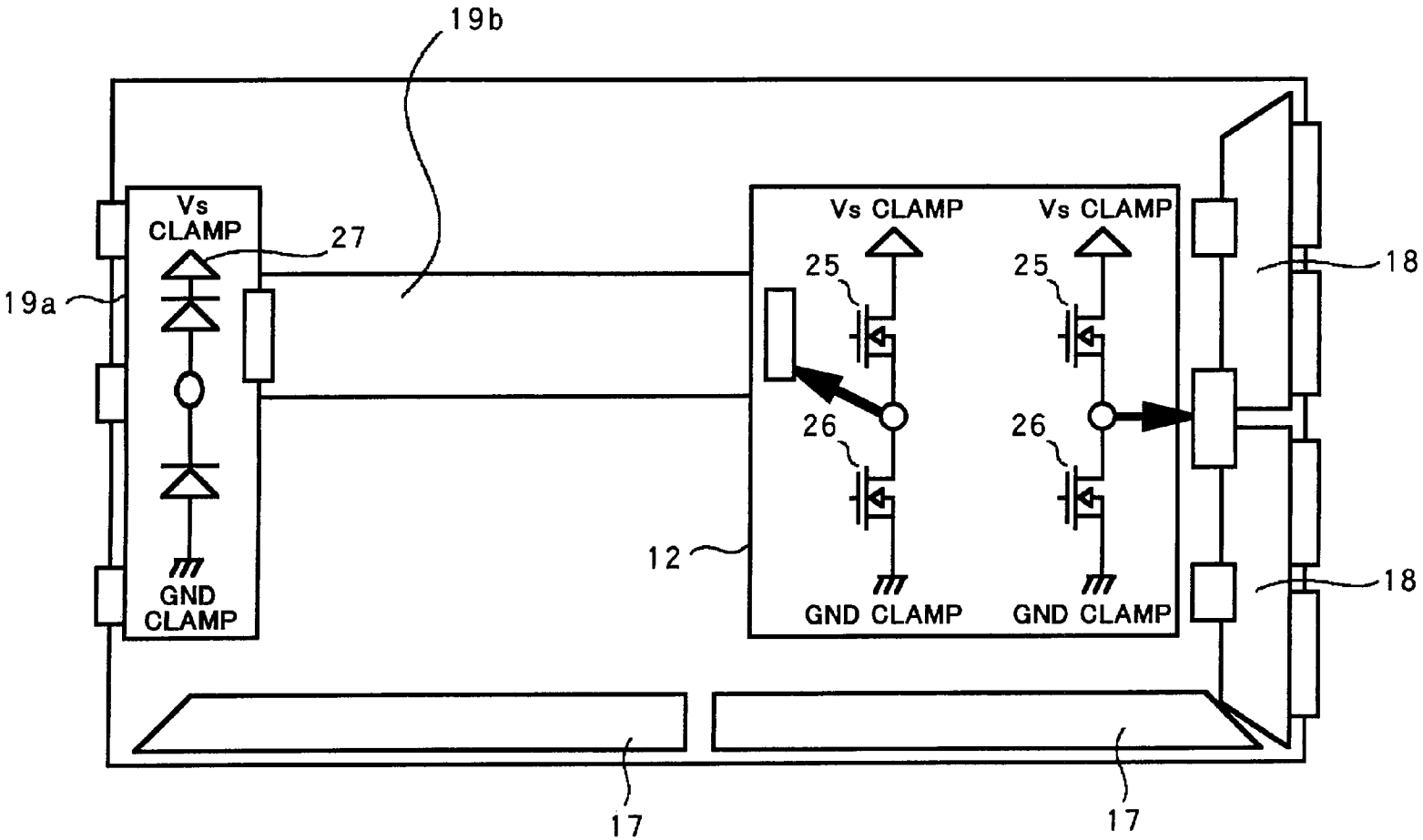
FIG. 16 is a plan view of the driver circuit illustrated in FIG. 10, showing the fourth advantage provided by the driver circuit.
Figure 17A:
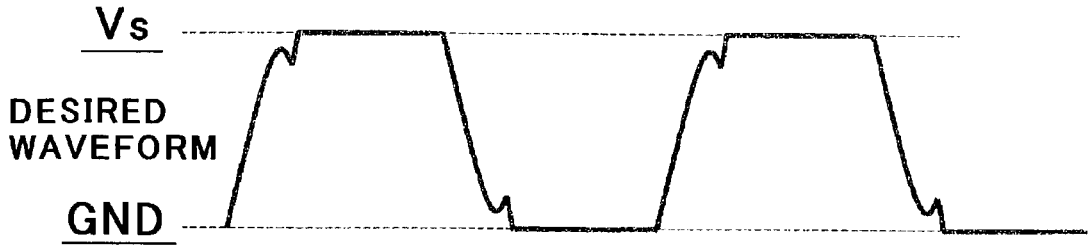
FIG. 17A illustrates a desired waveform of a signal to be output from the driver circuit illustrated in FIG. 10.
Figure 17B:
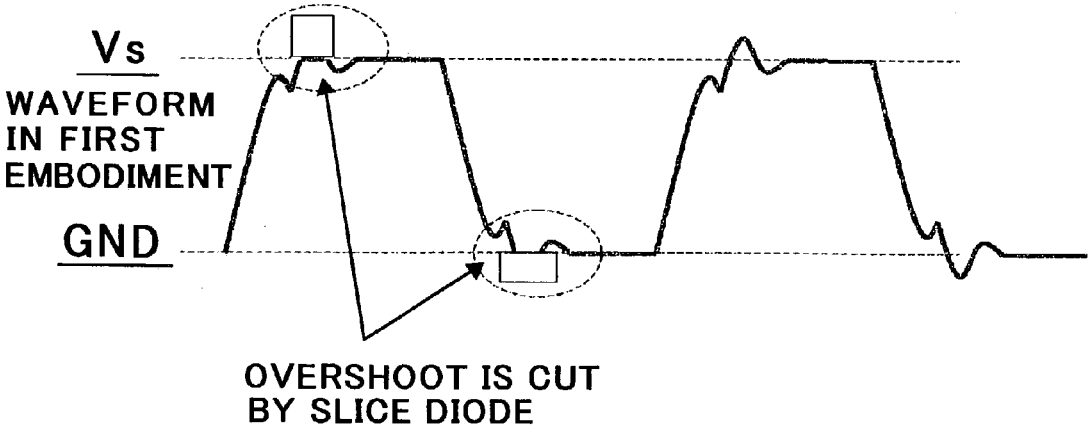
FIG. 17B illustrates an actual waveform of a signal output from the driver circuit illustrated in FIG. 10.
Figure 18:
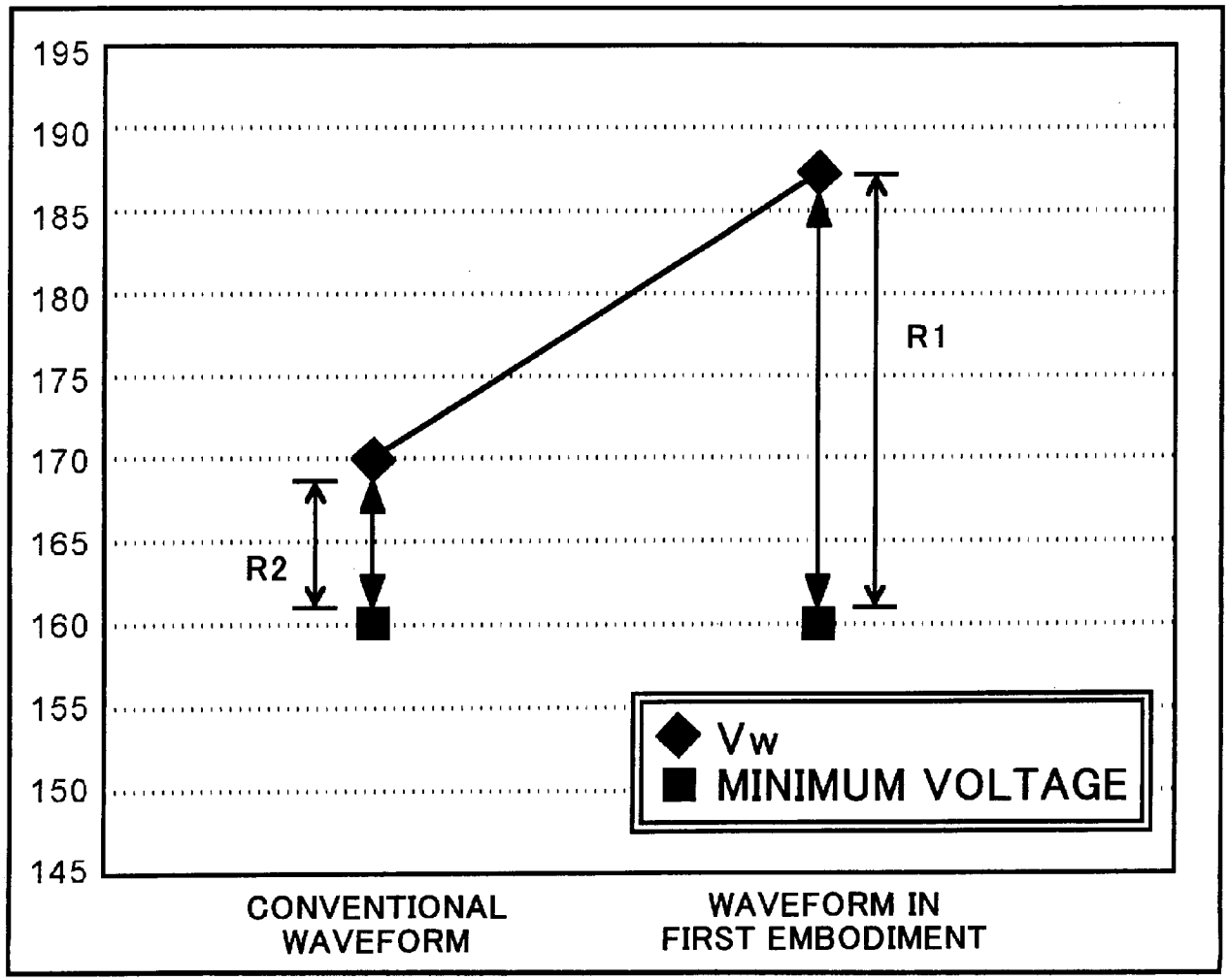
FIG. 18 is a graph showing a relation between a voltage at which a plasma display panel is driven and waveforms in both the conventional driver circuit and the driver circuit in accordance with the first embodiment.

FIG. 16 shows the fourth advantage provided by the driver circuit 10. FIG. 17A illustrates a desired waveform of a signal to be output from the driver circuit 10, and FIG. 17B illustrates an actual waveform of a signal output from the driver circuit 10. FIG. 18 is a graph showing a relation between a drive voltage and waveforms of signals output from both the conventional driver circuit 90 and the driver circuit 10 in accordance with the first embodiment.

In the driver circuit 10 in accordance with the first embodiment, clamping circuits such as a Vs clamp circuit 25 or a GND clamp circuit 26 are all mounted on the substrate 12. Hence, a waveform-shaping slice diode 27 can be located in the vicinity of the plasma display panel 11 by means of the first and second relay substrates 19*a* and 19*b*.

As a result, as illustrated in FIG. 17B, it is possible to cut overshoot caused by parasitic inductance of the substrate 12, by means of the slice diode 27, ensuring that a waveform of an output signal can be made similar to the desired waveform illustrated in FIG. 17A. Thus, as illustrated in FIG. 18, a range R1 of a drive voltage (drive margin) associated with the driver circuit 10 can be broadened in comparison with the same R2 associated with a waveform output from the conventional driver circuit 90.

Since the substrate 12 is arranged closer to a scanning section than a common section in the driver circuit 10, it is not necessary to arrange a slice diode in the scanning section. If the substrate 12 is located away from a scanning section, it would be possible to arrange a slice diode in a scanning section to thereby cut wave-shaped overshoot.

Figure 19:
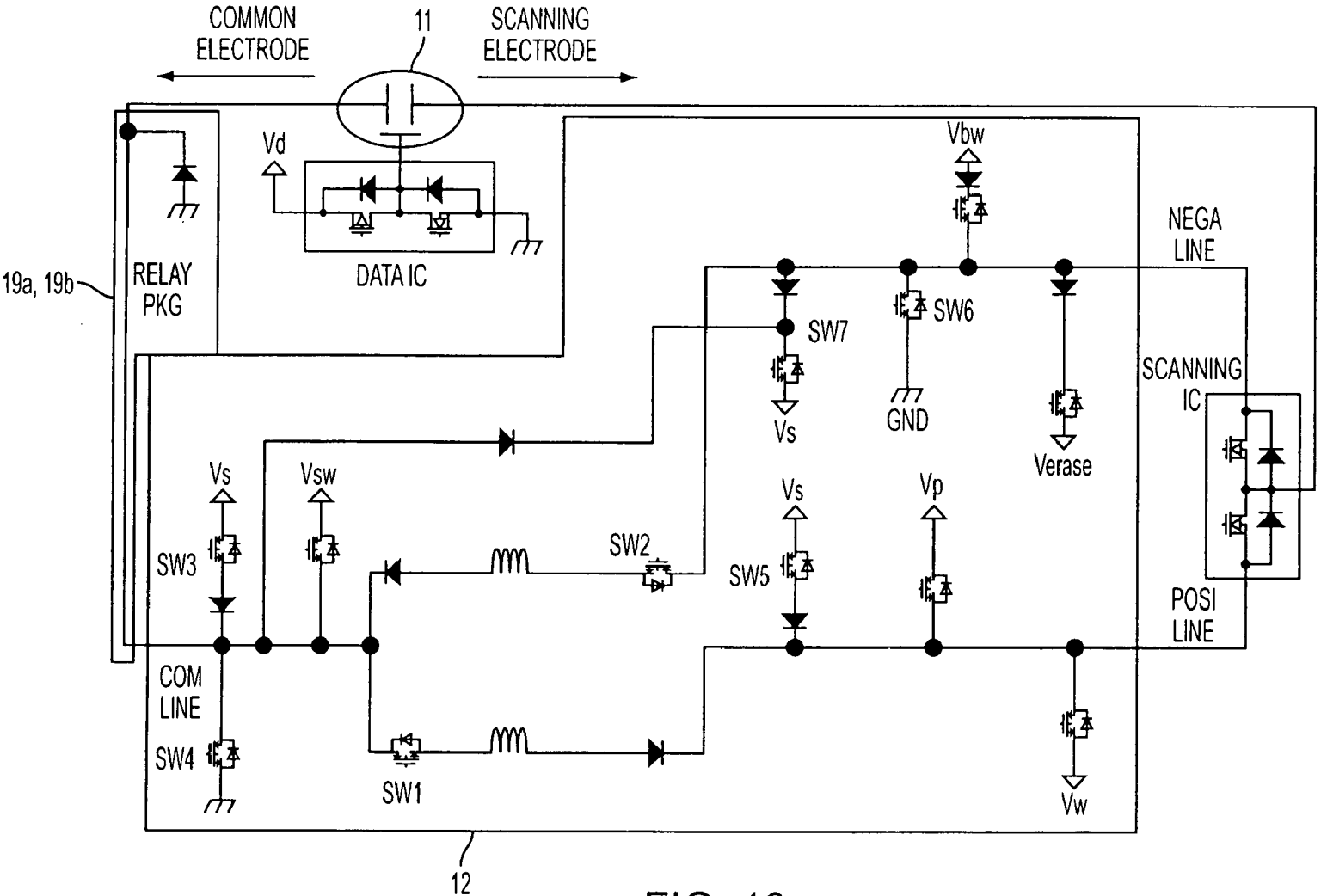
FIG. 19 is a block diagram of the driver circuit illustrated in FIG. 10, showing the fifth advantage provided by the driver circuit.
Figure 20:
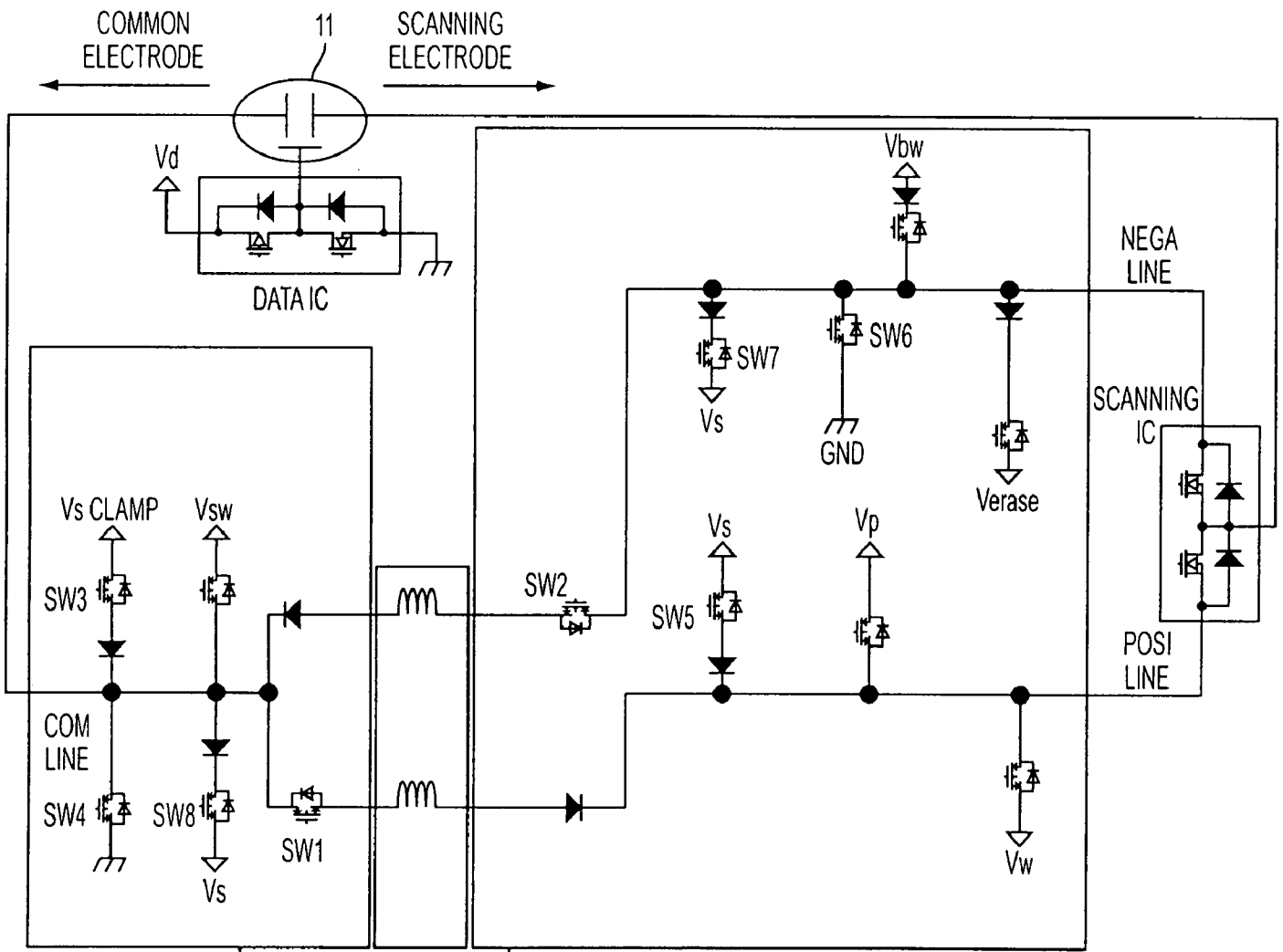
FIG. 20 PRIOR ART
FIG. 20 is a block diagram of a conventional driver circuit for driving a plasma display panel.

FIG. 19 shows the fifth advantage provided by the driver circuit 10. FIG. 20 is a circuit diagram of the conventional driver circuit 90.

As illustrated in FIG. 20, the common substrate 100 in the conventional driver circuit 90 had to include four switching elements SW1, SW3, SW4 and SW8 as parts of a Vs reverse circuit.

In contrast, the substrate 12 in the driver circuit 10 in accordance with the first embodiment includes three switching elements SW1, SW3 and SW4 in an area corresponding to the common substrate 100, as illustrated in FIG. 19. That is, the driver circuit 10 makes it possible to reduce the number of switching elements for constituting a Vs reverse circuit, by one, ensuring simplification of a structure of the driver circuit 10 and reduction in fabrication cost of the driver circuit 10.

FIG. 21A illustrates signal waveforms showing operation of the switching elements SW1 to SW8, and further illustrates waveforms of signals output from a scanning section driving circuit and a common section driving circuit in the conventional driver circuit 90 illustrated in FIG. 20, and FIG. 21B illustrates signal waveforms showing operation of the switching elements SW1 to SW7, and further illustrates waveforms of signals output from a scanning section driving circuit and a common section driving circuit in the driver circuit 10 illustrated in FIG. 19.

As is obvious in light of comparison of FIG. 21A with FIG. 21B, the driver circuit 10 in accordance with the first embodiment can output signals having the same waveforms as those of the conventional driver circuit 90, even if the number of switching elements for constituting a Vs reverse circuit in the driver circuit 10 is smaller by one than the same in the conventional driver circuit 90. This is because a distance between an area corresponding to the conventional common substrate 100 and an area corresponding to the conventional scanning substrate 101 is shortened by virtue of the use of the substrate 12 in place of the common substrate 100 and the scanning substrate 101.

Figure 22:
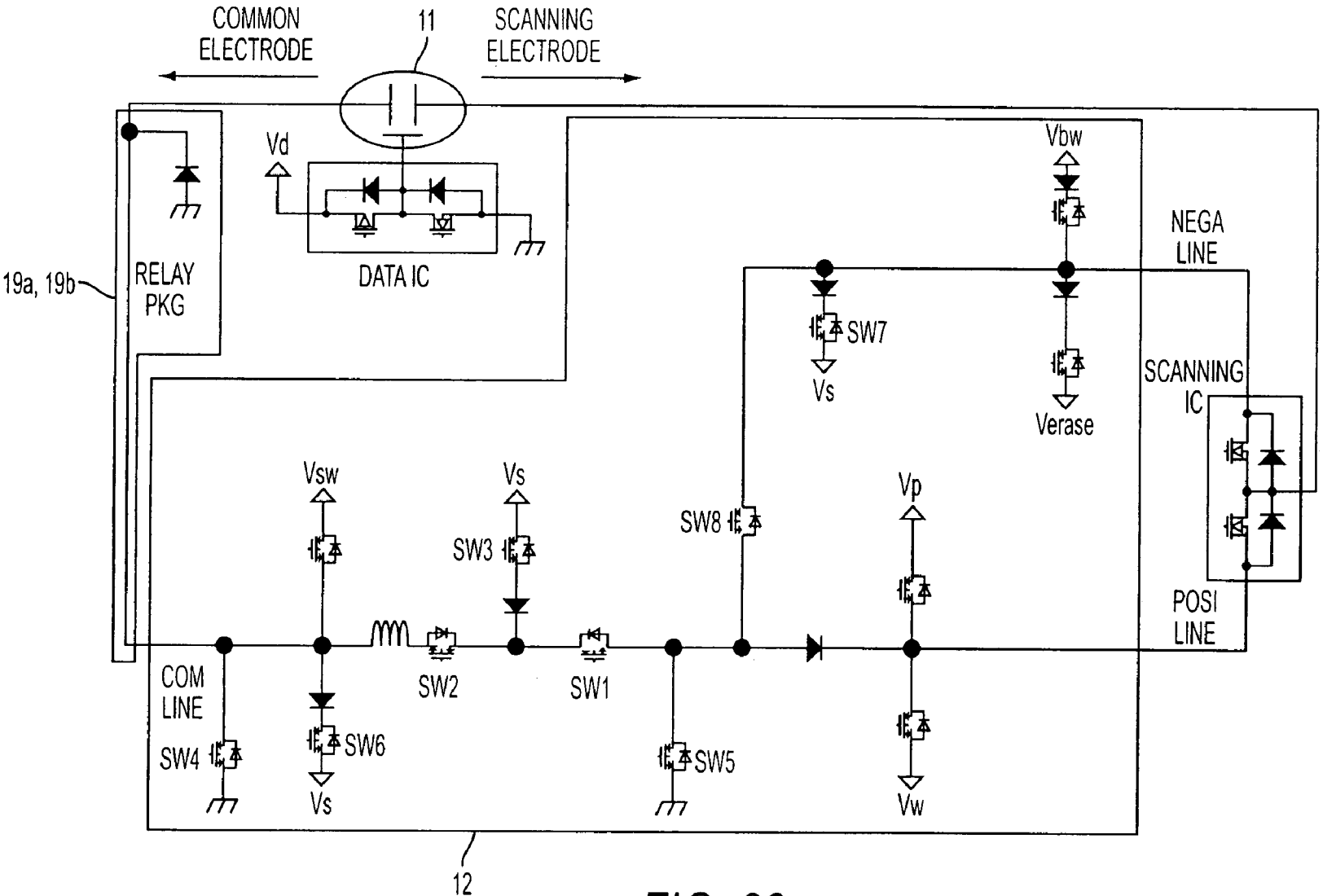
FIG. 22 is a block diagram of the driver circuit illustrated in FIG. 10, showing the sixth advantage provided by the driver circuit.
Figure 23:
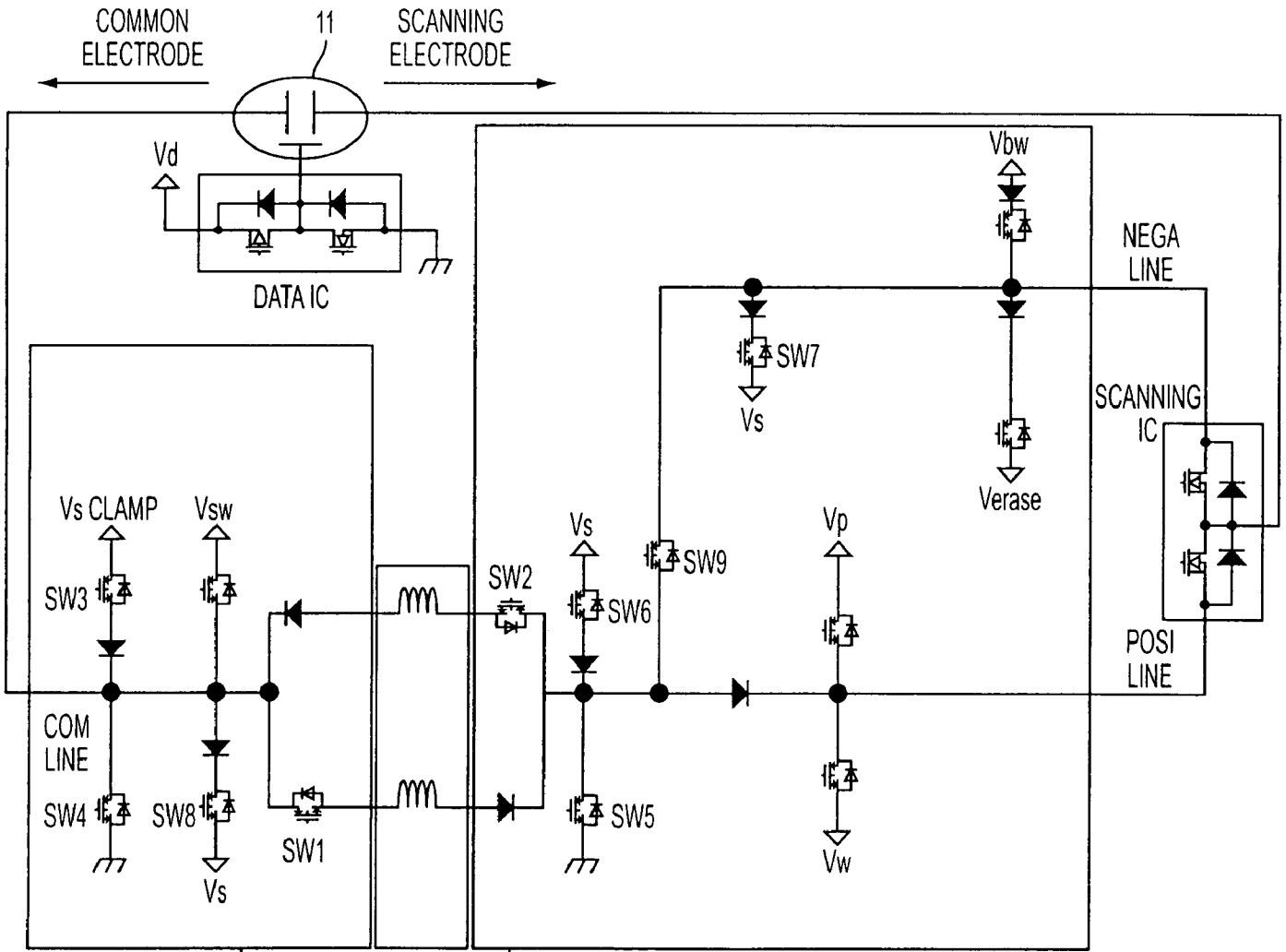
FIG. 23 PRIOR ART
FIG. 23 is a block diagram of a conventional driver circuit for driving a plasma display panel.

FIG. 22 shows the sixth advantage provided by the driver circuit 10. FIG. 23 is a circuit diagram of the conventional driver circuit 90.

As illustrated in FIG. 23, the common substrate 100 in the conventional driver circuit 90 had to include three switching elements SW3, SW4 and SW8 as parts of a Vs clamp circuit.

In contrast, the substrate 12 in the driver circuit 10 in accordance with the first embodiment includes two switching elements SW4 and SW6 in an area corresponding to the common substrate 100, as illustrated in FIG. 22. That is, the driver circuit 10 makes it possible to reduce the number of switching elements for constituting a Vs clamp circuit, by one, ensuring simplification of a structure of the driver circuit 10 and reduction in fabrication cost of the driver circuit 10.

Figure 24A:
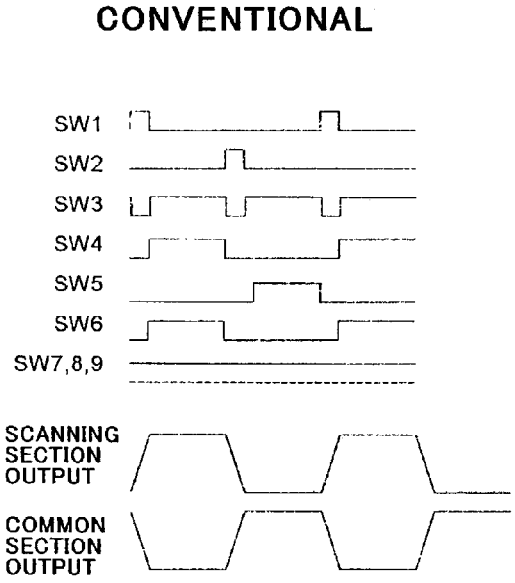
FIG.24A PRIOR ART
FIG. 24A is a signal chart showing an operation of a conventional driver circuit for driving a plasma display panel.
Figure 24B:
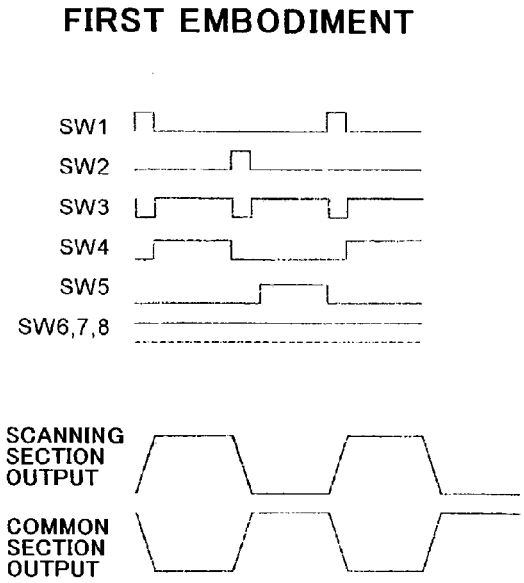
FIG. 24B is a signal chart showing an operation of the driver circuit for driving a plasma display panel, in accordance with the first embodiment.

FIG. 24A illustrates signal waveforms showing operation of the switching elements SW1 to SW9, and further illustrates waveforms of signals output from a scanning section driving circuit and a common section driving circuit in the conventional driver circuit 90 illustrated in FIG. 23, and FIG. 24B illustrates signal waveforms showing operation of the switching elements SW1 to SW8, and further illustrates waveforms of signals output from a scanning section driving circuit and a common section driving circuit in the driver circuit 10 illustrated in FIG. 22.

As is obvious in light of comparison of FIG. 24A with FIG. 24B, the driver circuit 10 in accordance with the first embodiment can output signals having the same waveforms as those of the conventional driver circuit 90, even if the number of switching elements for constituting a Vs clamp circuit in the driver circuit 10 is smaller by one than the same in the conventional driver circuit 90. This is because a distance between an area corresponding to the conventional common substrate 100 and an area corresponding to the conventional scanning substrate 101 is shortened by virtue of the use of the substrate 12 in place of the common substrate 100 and the scanning substrate 101.

Second Embodiment

Figure 25:
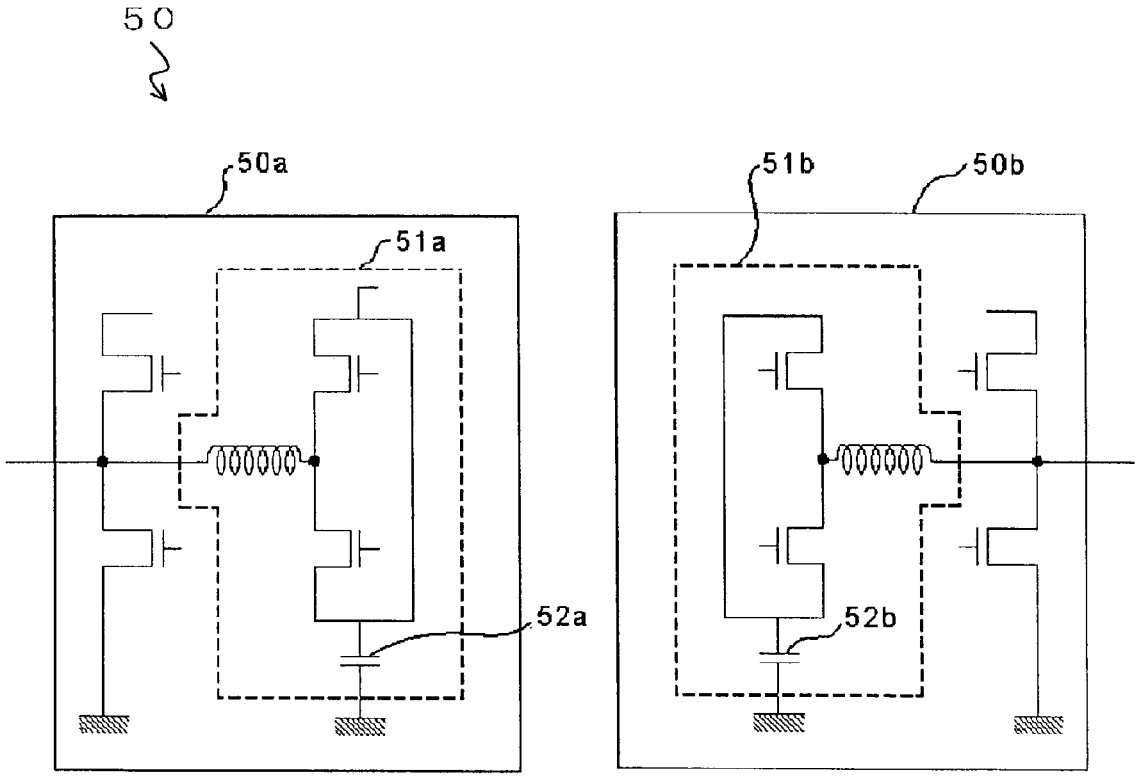
FIG.25 PRIOR ART
FIG. 25 is a block diagram of a conventional driver circuit for driving a plasma display panel.

FIG. 25 is a block diagram of a conventional driver circuit 50 for driving a plasma display panel.

The driver circuit 50 is comprised of a common substrate (not illustrated), a scanning substrate (not illustrated), a first driver circuit 50*a* associated with the common substrate, and a second driver circuit 50*b* associated with the scanning substrate. The first and second driver circuits 50*a* and 50*b* include circuits 51*a* and 51*b* for collecting electric charges, respectively. Each of the circuits 51*a* and 51*b* is electrically connected to an output stage thereof, and includes a capacitor 52*a* and 52*b*, respectively, for accumulating electric charges therein.

The driver circuit 50 does not include a substrate corresponding to the relay substrate 111 illustrated in FIG. 2.

Figure 26:
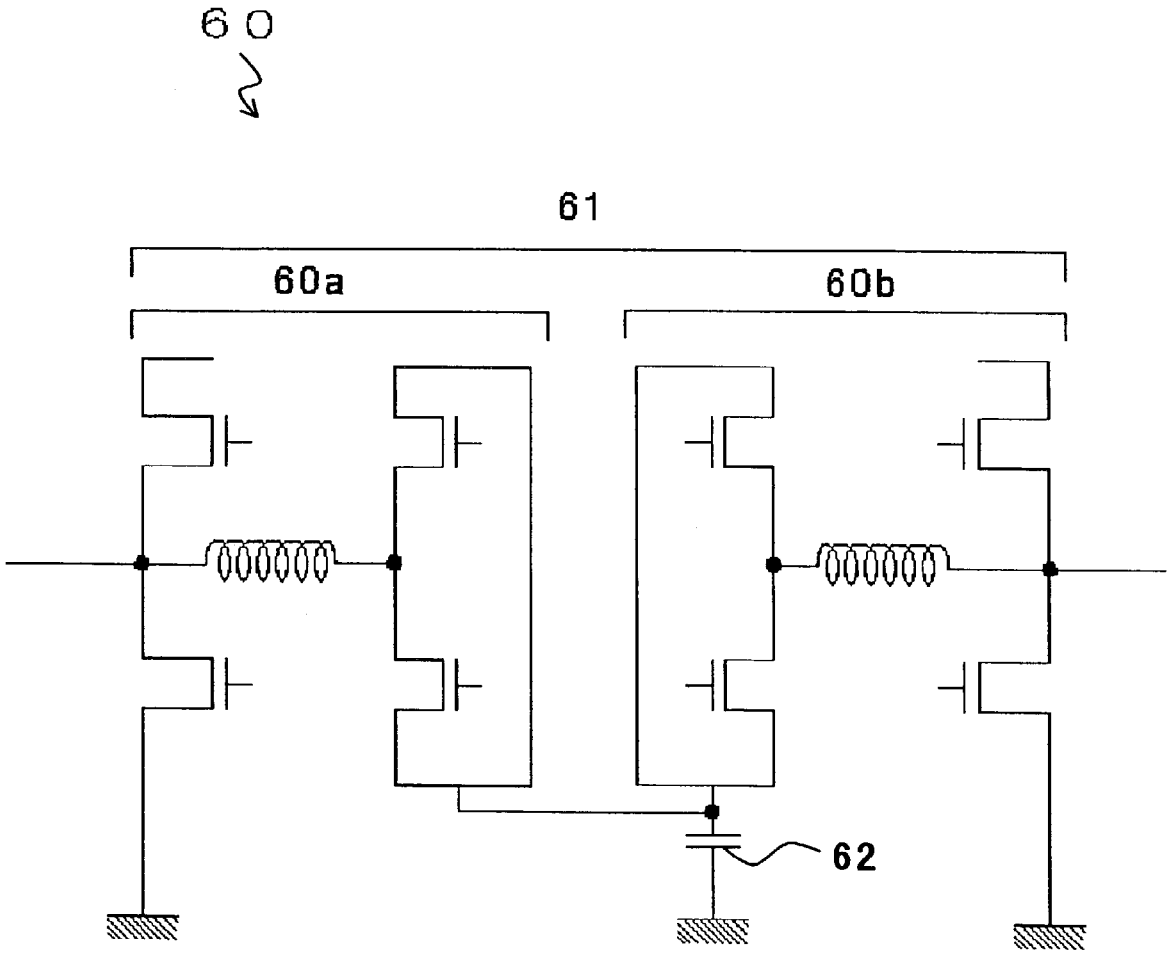
FIG. 26 is a block diagram of a driver circuit for driving a plasma display panel, in accordance with the second embodiment of the present invention.

FIG. 26 is a block diagram of a driver circuit 60 for driving a plasma display panel, in accordance with the second embodiment.

Similarly to the driver circuit 10 in accordance with the first embodiment, the driver circuit 60 is designed to include a single substrate in place of common and scanning substrates. In addition, driver circuits 60*a* and 60*b* corresponding to the first and second driver circuits 50*a* and 50*n* are formed as a single driver circuit 61.

The conventional driver circuit 50 had to include two capacitors 52*a* and 52*b*. In contrast, the driver circuit 60 is designed to include only one capacitor 62 used commonly by the driver circuits 60*a* and 60*b*, because the driver circuits 60*a* and 60*b* are formed as a single driver circuit 61.

The driver circuit 60 in accordance with the second embodiment makes it possible to reduce the number of capacitors to one from two, because the driver circuits 60*a* and 60*b* as common and scanning section driver circuits commonly use the single capacitor 62.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2002-150012 filed on May 24, 2002 including specification, claims, drawings and summary is incorporated herein by reference in its entirety.

What is claimed is:

1. A circuit for driving a plasma display panel comprising:

a first circuit for driving a scanning electrode of said plasma display panel;

a second circuit for driving a common electrode of said plasma display panel;

a single substrate on which said first circuit and said second circuit are formed;

a relay substrate arranged between said second circuit and said plasma display panel to electrically connect said second circuit to said common electrode; and a waveform-shaping slice diode mounted on said relay substrate for reducing overshoot of an output signal of said second circuit.

2. The circuit as set forth in claim 1, further comprising a ground line formed on said single substrate for electrically connecting a first clamp circuit associated with said first circuit and a second clamp circuit associated with said second circuit to each other.

3. The circuit as set forth in claim 1, wherein said waveform-shaping slice diode is located in the vicinity of an edge of said plasma display panel.

4. A circuit for driving a plasma display panel comprising:

a first circuit for driving a scanning electrode of said plasma display panel;

a second circuit for driving a common electrode of said plasma display panel;

a single substrate on which said first circuit and said second circuit are formed;

a relay substrate arranged between said first circuit and said plasma display panel to electrically connect said first circuit to said scanning electrode; and a waveform-shaping slice diode mounted on said relay substrate for reducing overshoot of an output signal of said first circuit.

5. The circuit as set forth in claim 4, wherein said waveform-shaping slice diode is located in the vicinity of an edge of said plasma display panel.

6. A circuit for driving a plasma display panel, comprising:

a first circuit for driving a scanning electrode of said plasma display panel, said first circuit including a third circuit for collecting electric charges, said third circuit including a single capacitor for accumulating electric charges therein;

a second circuit for driving a common electrode of said plasma display panel, said second circuit including a fourth circuit for collecting electric charges, said fourth circuit including said single capacitor in common with said third circuit;

a single substrate on which said first and second circuits are formed;

a relay substrate arranged between said second circuit and said plasma display panel to electrically connect said second circuit to said common electrode; and a waveform-shaping slice diode mounted on said relay substrate for reducing overshoot of an output signal of said second circuit.

7. The circuit as set forth in claim 6, further comprising a ground line formed on said single substrate for electrically connecting a first clamp circuit associated with said first circuit and a second clamp circuit associated with said second circuit to each other.

8. The circuit as set forth in claim 6, further comprising a $V_s$ reverse circuit used commonly by said first and second circuits.

9. The circuit as set forth in claim 6, further comprising a $V_s$ clamp circuit used commonly by said first and second circuits.

10. The circuit as set forth in claim 6, wherein said waveform-shaping slice diode is located in the vicinity of an edge of said plasma display panel.

11. A circuit for driving a plasma display panel, comprising:

a first circuit for driving a scanning electrode of said plasma display panel, said first circuit including a third circuit for collecting electric charges, said third circuit including a single capacitor for accumulating electric charges therein;

a second circuit for driving a common electrode of said plasma display panel, said second circuit including a fourth circuit for collecting electric charges, said fourth circuit including said single capacitor in common with said third circuit;

a single substrate on which said first and second circuits are formed;

a relay substrate arranged between said first circuit and said plasma display panel to electrically connect said first circuit to scanning electrode; and a waveform-shaping slice diode mounted on said relay substrate for reducing overshoot of an output signal of said first circuit.

12. The circuit as set forth in claim 11, wherein said waveform-shaping slice diode is located in the vicinity of an edge of said plasma display panel.

13. A circuit for driving a plasma display panel comprising:

a first circuit for driving a scanning electrode of said plasma display panel;

a second circuit for driving a common electrode of said plasma display panel;

a third circuit for collecting electric charges, wherein said third circuit connects said first circuit and said second circuit to each other therethrough;

a relay substrate which is arranged facing a rear surface of said plasma display panel to electrically connect said second circuit to said common electrode;

a single substrate on which said first circuit, said second circuit, and said third circuit are formed, said single substrate being arranged facing the rear surface of said plasma display panel, a first end of said single substrate being electrically connected to a first end of said plasma display panel, a second end of said single substrate being electrically connected to a second end of said plasma display panel through said relay substrate; and a waveform-shaping slice diode mounted on said relay substrate for reducing overshoot of an output signal of said second circuit.

14. The circuit as set forth in claim 13, wherein said connector substrate comprises:

a first substrate arranged facing the second end of said plasma display panel; and a second substrate mechanically and electrically connecting said single substrate and said first substrate to each other.

15. The circuit as set forth in claim 13, further comprising a ground line formed on said single substrate for electrically connecting a first clamp circuit associated with said first circuit and a second clamp circuit associated with said second circuit to each other.

16. The circuit as set forth in claim 13, wherein said waveform-shaping slice diode is located in the vicinity of an edge of said plasma display panel.

17. A circuit for driving a plasma display panel, comprising:

a first circuit for driving a scanning electrode of said plasma display panel;

a second circuit for driving a common electrode of said plasma display panel;

a third circuit for collecting electric charges, wherein said third circuit connects said first circuit and said second circuit to each other therethrough;

a relay substrate which is arranged facing a rear surface of said plasma display panel to electrically connect said first circuit to said scanning electrode;

a single substrate on which said first circuit, said second circuit, and said third circuit are formed, said single substrate being arranged facing the rear surface of said plasma display panel, a first end of said single substrate being electrically connected to a first end of said plasma display panel, and a second end of said single substrate being electrically connected to a second end of said plasma display panel through said relay substrate; and a waveform-shaping slice diode mounted on said relay substrate for reducing overshoot of an output signal of said first circuit.

18. The circuit as set forth in claim 17, wherein said waveform-shaping slice diode is located in the vicinity of an edge of said plasma display panel.

19. A circuit for driving a plasma display panel comprising:

a first circuit for driving a scanning electrode;

a second circuit for driving a common electrode; and a single capacitor for accumulating electric charges from said first circuit and said second circuit;

wherein said first circuit, said second circuit, and said single capacitor are formed on a single substrate.

20. The circuit as set forth in claim 19, further comprising a ground line formed on said single substrate for electrically connecting a first clamp circuit associated with said first circuit and a second clamp circuit associated with said second circuit to each other.

21. The circuit as set forth in claim 19, further comprising a waveform-shaping slice diode.

* * * * *